US006805067B1

(12) United States Patent
Cusanelli

(10) Patent No.: US 6,805,067 B1
(45) Date of Patent: Oct. 19, 2004

(54) CONTOUR STERN FLAP

(75) Inventor: Dominic S. Cusanelli, Frederick, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 61 days.

(21) Appl. No.: 10/219,387

(22) Filed: Aug. 14, 2002

(51) Int. Cl.[7] ..... B63B 1/00
(52) U.S. Cl. ..... 114/271; 114/343
(58) Field of Search ..... 114/343, 271, 114/285, 286, 287, 288, 290, 291

(56) References Cited

U.S. PATENT DOCUMENTS

| | | | | | |
|---|---|---|---|---|---|
| 1,752,406 | A | * | 4/1930 | Wetch | 114/285 |
| 3,313,262 | A | * | 4/1967 | Yunker et al. | 114/287 |
| 4,487,152 | A | | 12/1984 | Larson | 114/274 |
| 4,519,336 | A | * | 5/1985 | Mason | 114/286 |
| 4,813,365 | A | * | 3/1989 | Lindstrom et al. | 114/271 |
| 4,896,622 | A | | 1/1990 | Thomas | 114/285 |
| 4,961,396 | A | | 10/1990 | Sasagawa | 114/285 |
| 5,224,436 | A | * | 7/1993 | Stricker | 114/274 |
| 5,293,832 | A | * | 3/1994 | Potter, Jr. | 114/343 |
| 5,425,325 | A | | 6/1995 | Washio | 114/290 |
| 5,572,944 | A | * | 11/1996 | Slikkers et al. | 114/343 |
| 5,628,272 | A | | 5/1997 | Thomas | 114/285 |
| 6,038,995 | A | * | 3/2000 | Karafiath et al. | 114/271 |
| 6,425,341 | B1 | * | 7/2002 | Devin | 114/288 |

OTHER PUBLICATIONS

Mary Zoccola, "The Use of Stern Flap Technology Spreads to Other Ships," *Wavelengths: An Employee's Digest of Events and Issues*, Sep. 2001; Internet version (5 pages) obtained from NSWCCD (Naval Surface Warfare Center, Carderock Division) website at http://www.dt.navy.mil/pao/excerpts%20pages/2001/sternFlap9_01.html.

Dominic S. Cusanelli and Gabor Karafiath, "Advances in Stern Flap Design and Application," FAST 2001 (The Sixth International Conference on Fast Sea Transportation), Southampton, U.K., Sep. 4–6, 2001 (14 pages).

Dominic S. Cusanelli, "Stern Flap Powering Performance on the PC–1 Class Patrol Coastal, Full Scale Trials and Model Experiments," Patrol '96 Conference, New Orleans, Louisiana, Dec. 5–7, 1996 (13 pages).

Dominic S. Cusanelli and Kenneth M. Forgach, "Stern Flaps for Enhanced Powering Performance," Twenty–Fourth American Towing Tank Conference, College Station, Texas, Nov. 2–3, 1995 (12 pages).

* cited by examiner

*Primary Examiner*—S. Joseph Morano
*Assistant Examiner*—Lars A. Olson
(74) *Attorney, Agent, or Firm*—Howard Kaiser

(57) ABSTRACT

A stern flap has a "contour" shape which facilitates installation thereof upon the curved stern of a ship. The stem flap's lower surface includes an intermediate region and two curvedly tapered end regions. The intermediate region is delineated forwardly by a curved leading edge and aftly by a parallelly curved trailing edge, the chord length therebetween being constant. The curve characterizing the flap's leading edge is congruent with the curve characterizing the ship stern's lower transverse edge (the junction between the ship's bottom and the ship's stern), thereby permitting contiguous disposition of the flap's leading edge relative to the ship's lower transverse edge, as well as permitting even and unbroken disposition of the flap's lower surface relative to the ship's bottom. The contour stem flap "fits" the ship's stern, thus lending itself to a hydrodynamically propitious mode of attachment whereby hydrodynamic efficiency is uncompromised.

16 Claims, 18 Drawing Sheets

40

40

CONTOUR STERN FLAP

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to the hydrodynamics of marine vessels, more particularly to adjuncts, appendages and auxiliary devices for affecting same.

A stem flap is an extension of the hull bottom surface which extends aft of the transom. It is a relatively small appendage (typically constructed so as to include internal metal bracing beams and external metal plate material) which is fitted to the ship's transom. Critical stern flap geometry parameters include: (i) chord length, (ii) span across the transom; and, (ii) an angle denoted as "trailing edge down" (TED), referenced to the local buttock slope (run) at the transom. The main purpose of a stern flap device is to reduce the shaft power required to propel a ship through the water, thereby reducing the engine's fuel consumption and increasing the ship's top speed and range.

The application of stern flaps to large displacement vessels is a fairly recent innovation. The U.S. Navy has been investigating the use of stern flaps on many different hull types. Stern flaps have now been proven by the U.S. Navy to reduce the requisite amount of propulsive power during navigation, with several concomitant advantages. Stern flaps: foster reductions in operating and life-cycle costs through fuel savings; increase both ship speed and range; decrease the amount of pollutants released by ships into the atmosphere; and, reduce propeller loading, cavitation, vibration and noise tendencies.

Incorporated herein by reference is the following United States patent which is pertinent to stern flaps: Karafiath et al. U.S. Pat. No. 6,038,995 issued 21 Mar. 2000, entitled "Combined Wedge-Flap for Improved Ship Powering." The following papers, each of which is incorporated herein by reference, are also pertinent to stern flaps: Karafiath, G., D. S. Cusanelli, and C. W. Lin, "Stem Wedges and Stern Flaps for Improved Powering—U.S. Navy Experience," 1999 SNAME Annual Meeting (paper), Baltimore, Md. (September 1999); Cusanelli, D. S., "Stern Flaps—A Chronicle of Success at Sea (1989–2002)," SNAME Innovations in Marine Transportation, Pacific Grove, Calif. (May 2002); Cave, W. L., and D. S. Cusanelli, "Effect of Stem Flaps on Powering Performance of the FFG-7 Class," SNAME Chesapeake Sect Paper, (October 1989); Cusanelli, D. S., and W. L. Cave, "Effect of Stern Flaps on Powering Performance of the FFG-7 Class," *Marine Technology*, Vol. 30, No. 1, pp 39–50, (January 1993); Cusanelli, D. S., and K. M. Forgach, "Stem Flaps for Enhanced Powering Performance," Proceedings of 24th ATTC, College Station, Tex. (November 1995); Cusanelli, D. S., "Stern Flap Powering Performance on the PC 1 Class Patrol Coastal, Full Scale Trials and Model Experiments," PATROL '96 Conference Proceedings, New Orleans, La., (December 1996); Cusanelli, D. S.; "Integrated Wedge-Flap, an Energy Saving Device," 21st UJNR Marine Facilities Panel Meeting, Tokyo, Japan (May 1997); Cusanelli, D. S., and G. Karafiath, "Integrated Wedge-Flap for Enhanced Powering Performance," FAST '97, Fourth International Conference on Fast Sea Transportation, Sydney, Australia, (July 1997); Cusanelli, D. S., "Stem Flap Installations on Three US Navy Ships," ASNE 1998 Symposium—21st Century Combatant Technology, Biloxi, Miss. (January 1998); Cusanelli, D. S. and L. Hundley, "Stern Flap Powering Performance on a SPRUANCE Class Destroyer, Full Scale Trials and Model Experiments," Research to Reality in Ship Systems Engineering Symposium, Tysons Corner, Va. (September 1998); Cusanelli, D. S. and L. Hundley, "Stem Flap Powering Performance on a SPRUANCE Class Destroyer, Full Scale Trials and Model Experiments," *Naval Engineers Journal*, Vol. 111, No. 2 (March 1999), Cusanelli, D. S., S. D. Jessup and S. Gowing, "Exploring Hydrodynamic Enhancements to the USS Arleigh Burke (DDG 51)," FAST'99, Fifth International Conference on Fast Sea Transportation, Seattle, Wash. (August 1999); Cusanelli, D. S., and G. Karafiath, "Energy Savings and Environmental Benefits of Stern Flaps on Navy Ships," ASNE Symposium: Marine Environmental Stewardship for the 21st Century, Arlington, Va. (October 1999); Cusanelli, D. S., and G. Karafiath, "Stem Flaps on Navy Ships, Fuel Savings and Environmental Benefits," IMT'99, Innovations in Marine Technology, New Orleans, La. (December 1999); Cusanelli, D. S., "Stern Flaps and Bow Bulbs for Existing Vessels—Reducing Shipboard Fuel Consumption and Emissions," United Nations Environmental Programme (UNEP 2001), Brussels, Belgium (February 2001); Cusanelli, D. S., and G. Karafiath, "Stern Flaps", *Professional Boat Builder Magazine*, pages 81–87, (April/May 2001); Karafiath, G, D. S. Cusanelli, S. D. Jessup and C. D. Barry, "Hydrodynamic Efficiency Improvements to the USCG 110 Ft. WPB Island Class Patrol Boats," 2001 SNAME Annual Meeting Paper, Orlando, Fla. (October 2001).

The standard (traditional or conventional) stern flap is designed with parallel, linear (straight) leading and trailing edges for orientation of these linear edges perpendicular to the ship centerline. The present inventor was tasked to apply existing stern flap technology to U.S. Coast Guard ships such as the HAMILTON Class or FAMOUS Class, wherein the hull design includes a highly curved transom. The inventor found that the standard stern flap had its limitations and would be disadvantageous for the task at hand. A configuration involving a standard stem flap and a curved transom would present various practical problems and would not be propitious.

To elaborate, installation of a standard stern flap on a highly curved transom would necessitate recession of the leading edge of the standard stern flap, at its centerline, under the transom. Full-scale installation and implementation would be difficult, particularly with regard to the arrangement and attachment of the partially recessed appendage to the curved transom. Moreover, such application of a standard stern flap with respect to a curved transom would inherently fail to fully utilize the entire stern flap chord length. In principle, a stern flap itself produces drag, and the stem flap's interactions with the hull, wave systems and propulsor produce the net decrease in required power. Generally, chord length is one of the parameters to be optimized; increase in effective ship length enhances reduction in ship wave resistance, and increase in stern flap total surface area increases the associated drag (resistance). The partial recess of the installed standard flap would directly limit the increased effective ship length associated with the stern flap installation. Furthermore, the partial recess of the flap would not make full use of the flap surface area.

SUMMARY OF THE INVENTION

In view of the foregoing, it is an object of the present invention to provide a stern flap which is superior to a standard stem flap for applications wherein a stem flap is being coupled with a marine vessel having a curved transom. The term "curved transom," as used herein, refers to a transom which is curved laterally, athwart, crosswise or transversely—i.e., a transom at least a portion of which describes a curve, across the transom, wherein the curve lies in an imaginary geometric plane which cuts across the transom so as to be at an angle with respect to (that is, so as not to be coincident with) the imaginary geometric plane generally described by the transom itself. Typically, a "curved transom" is a transom that "bulges" so as to be approximately symmetrically curved in a bilateral direction.

The present invention features a stern flap which is contoured to fit a curved transom. The inventor, a naval architect employed by the U.S. Navy, conceived his invention based on his realization that the application of stern flap technology to the highly curved transom of the U.S. Coast Guard ships of interest (such as the HAMILTON Class or FAMOUS Class) would necessitate a new flap plan form design shape. The inventor initially investigated his contour stem flap concept by conducting model-scale tests on this hullform which is characterized by a highly curved transom. The inventor thus demonstrated that the performance of a traditional flap design, when applied to this kind of hullform, was inferior to that of his new contour shape.

According to typical embodiments of the present invention, an adjunctive device is for use in association with a nautical vehicle which includes a stern characterized by a stern curvature across the stern. The present invention's adjunctive device includes an edge characterized by an edge curvature which at least substantially conforms with the stern curvature. The inventive adjunctive device is adaptable to association with the nautical vehicle so that the edge at least substantially adjoins the stern.

In accordance with many such inventive embodiments, the edge is a "leading edge," and the edge curvature is a leading edge curvature. The inventive adjunctive device includes a "trailing edge" which is characterized by a trailing edge curvature which at least substantially corresponds with the leading edge curvature. The nautical vehicle includes a bottom, the stern and bottom forming a crosswise junction which is characterized by the stern curvature. The inventive adjunctive device includes a lower surface which is at least substantially flat and is oppositely bounded by the leading edge and trailing edge. The distance generally across the lower surface between the leading edge and trailing edge is at least substantially constant. The inventive adjunctive device is adaptable to association with the nautical vehicle so that the nautical vehicle's bottom and the adjunctive device's lower surface are at least substantially flush, and so that the distance generally across the lower surface between the nautical vehicle's crosswise junction and the adjunctive device's trailing edge is at least substantially constant.

Many embodiments of the present invention provide a method of changing the hydrodynamic character of a hullform having a stern surface and a hull-bottom surface conjoinedly defining a curvilinear transverse stern edge. The inventive method comprises the steps of: (a) providing a flap having a curvilinear leading flap edge, a curvilinear trailing flap edge and a flap undersurface delimited by the leading flap edge and the trailing flap edge, wherein the curvilinearity of the leading flap edge is at least substantially equivalent to the curvilinearity of at least a portion of the transverse stern edge; and, (b) coupling the flap with the hullform so that the leading flap edge and the at least a portion of the transverse stem edge are at least substantially adjacent, thereby generally establishing a continuity between the hull-bottom surface and the flap undersurface.

The present invention affords several advantages when used in association with marine vessels having a stem characterized by a degree of lateral curvature, especially sterns characterized by larger degrees of lateral curvature. In accordance with typical embodiments the present invention, since both the leading and trailing edges of the flap match the transom radius of curvature, a constant chord length (as measured perpendicular to the transom knuckle) is maintained. Therefore, in inventive practice, full utilization is made of the flap chord length and total surface area.

Furthermore, conventional installation techniques (for effecting attachment of a stern flap to a marine vessel at the stern) are permitted by the present invention. The inventive geometric matching of the knuckle radius allows for surface installation of the contour stem flap on the transom, such installation involving only conventional welding of mostly flat plates that are at large angles to each other and to the hull; this is essentially the same technique presently utilized for installation of traditional flaps. In accordance with the present invention, the inventive contour stem flap can be separately manufactured and then installed (e.g., retrofitted) on an existing hull. Alternatively, a hull can be designed and manufactured "from scratch" in accordance with the present invention so as to include the inventive contour stem flap.

The inventor discloses certain aspects of his invention in the paper Dominic S. Cusanelli and Gabor Karafiath, "Advances in Stem Flap Design and Application," FAST 2001 (The Sixth International Conference on Fast Sea Transportation), Southhampton, United Kingdom, 4–6 Sep. 2001, incorporated herein by reference.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein.

Figure 5:
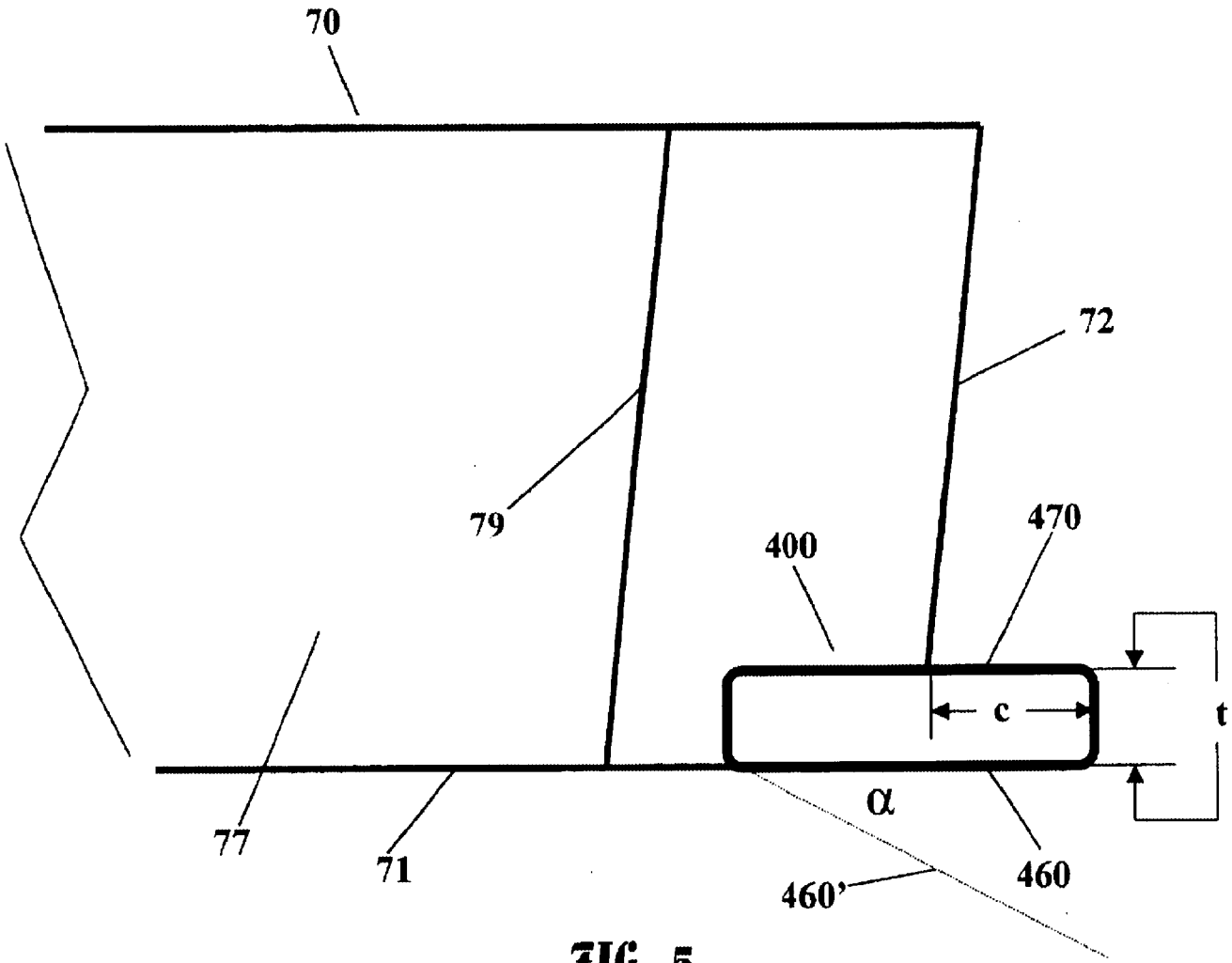
FIG. 5 is a diagrammatic side elevation view of the combination of the vessel (partially shown) and the inventive stern flap shown in FIG. 4, which has a bottom flap surface which proceeds horizontally from the transom.

and an inventive stern flap embodiment which, like that shown in FIG. 5, has an approximately planar (flat) bottom surface which approximately describes a linear profile. Also illustrated is an inventive embodiment characterized by a bottom flap surface which proceeds at a downward angle from the transom and which generally describes a conic sectional shape (rather than a plane, such as the inventive flap shown in FIG. 5).

Figure 6:
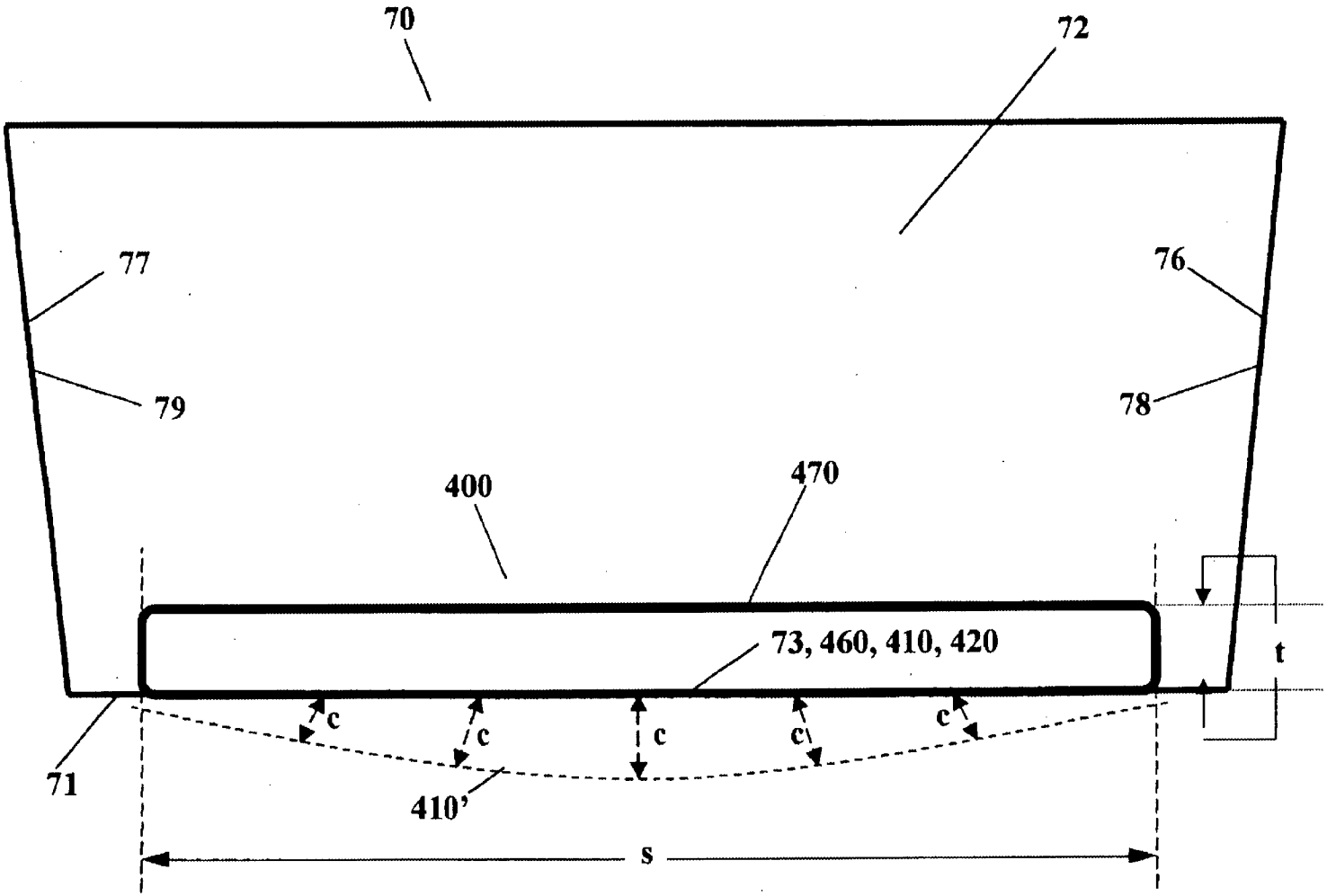
FIG. 6 is a diagrammatic rear elevation view of a representative marine vessel (such as partially shown in FIG. 2)
Figure 7:
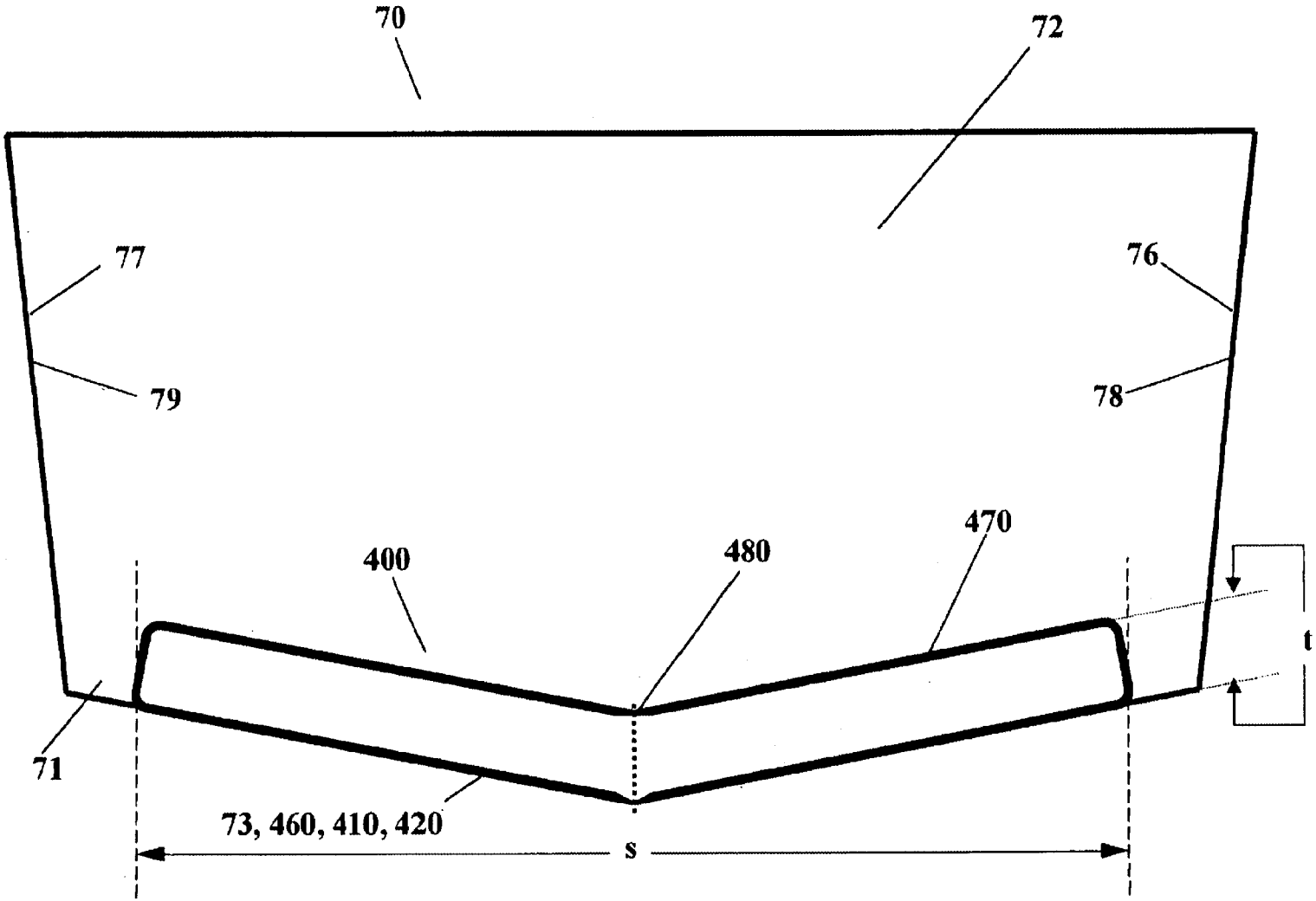

FIG. 7 is a diagrammatic rear elevation view, similar to the view shown in FIG. 6, wherein the inventive stern flap is an embodiment having a bottom flap surface which slants approximately linearly downward from its tips to an approximately medial vertex so as to approximately describe a "V"-shaped profile.

Figure 8:
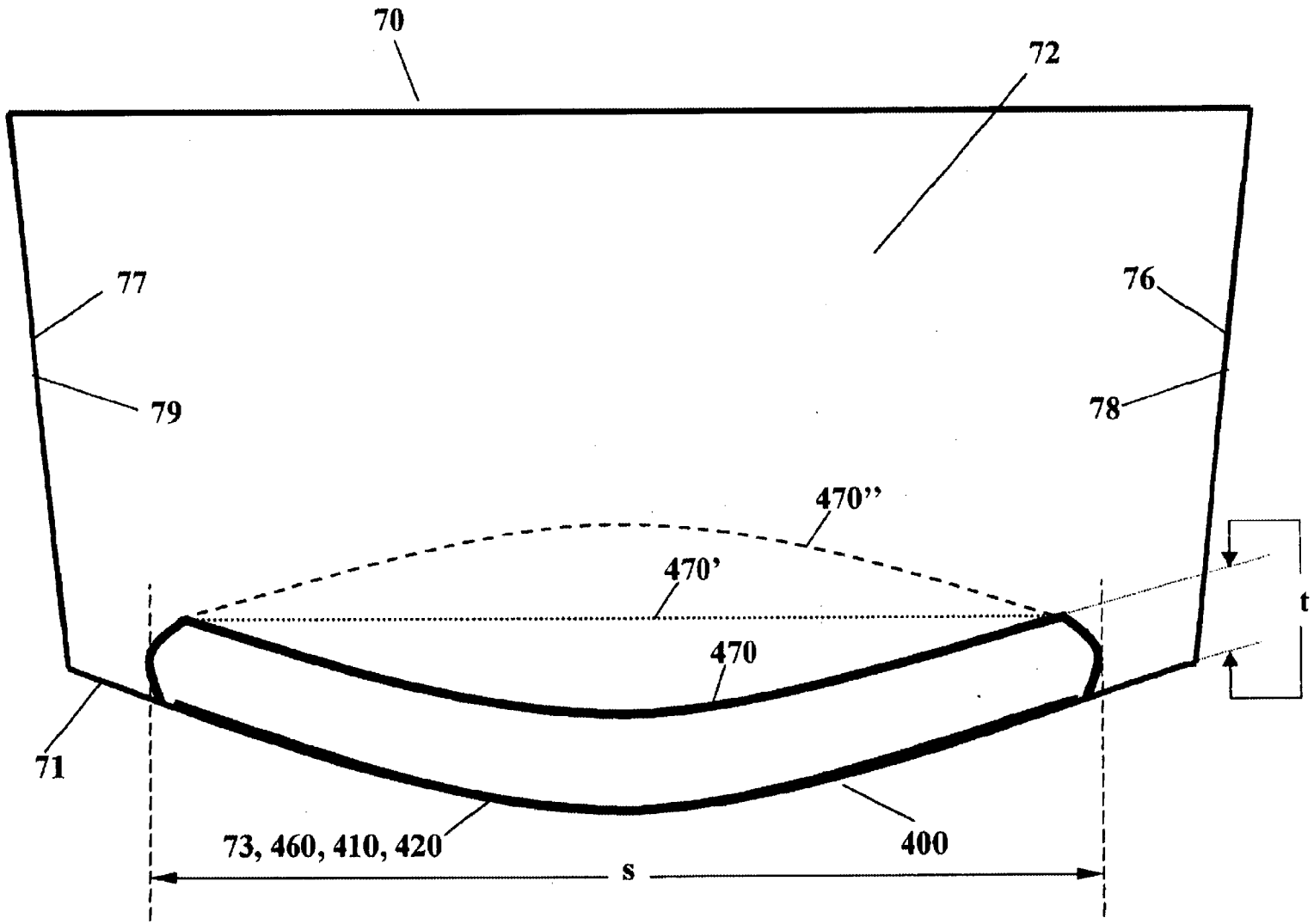

FIG. 8 is a diagrammatic rear elevation view, similar to the view shown in FIG. 6, wherein the inventive stern flap is an embodiment having a bottom flap surface which curves downward from its tips so as to describe curvilinear profile.

Figure 9:
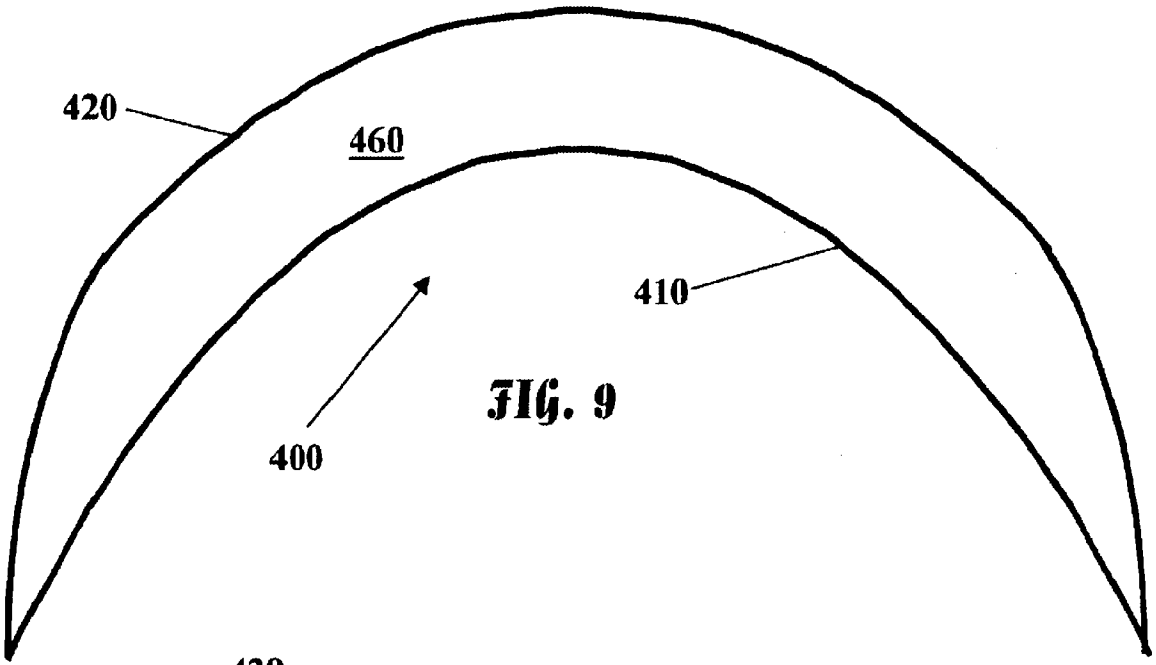

FIG. 9 is a diagrammatic bottom plan view of an inventive stem flap embodiment which is characterized by a relatively substantial degree of curvature of the trailing and leading edges.

Figure 10:
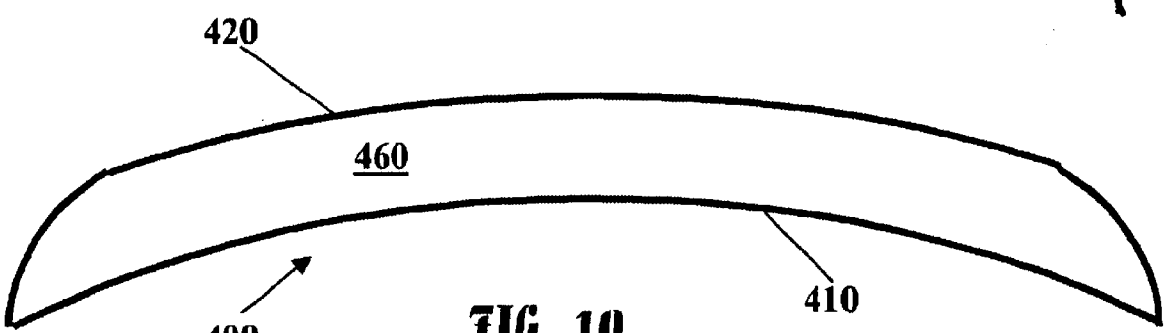
Figure 11:
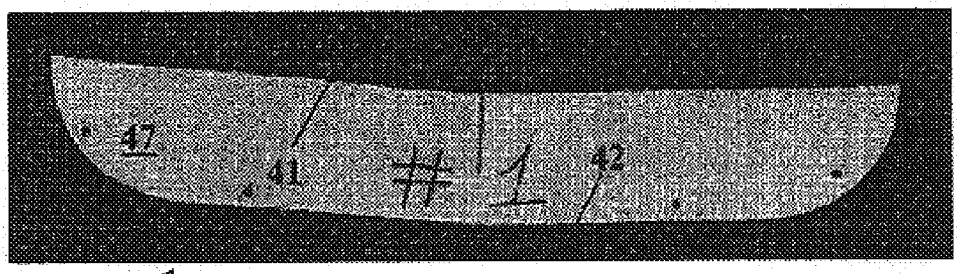
FIG. 11 PRIOR ART

FIG. 10 is a diagrammatic bottom plan view of an inventive stern flap embodiment which is characterized by a relatively modest degree of curvature of the trailing and leading edges.

FIG. 11, FIG. 12, FIG. 13 and FIG. 14 are photographic representations, substantially in top plan view, of various standard stern flap embodiments which were tested by the U.S. Navy on a ship model having a curved transom.

FIG. 15, FIG. 16, FIG. 17, FIG. 18, FIG. 19 and FIG. 20 are photographic representations, substantially in top plan view, of various inventive stern flap embodiments which were tested by the U.S. Navy on said ship model—i.e., the ship model mentioned in the preceding paragraph, on which the various standard stem flaps depicted in FIG. 11 through FIG. 14 were tested.

Figure 14:
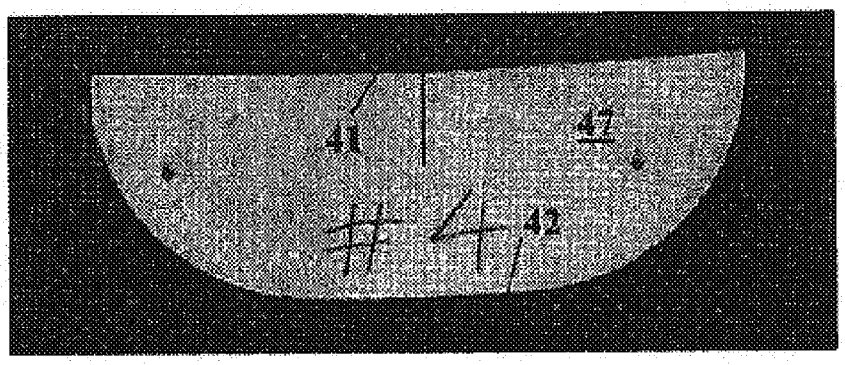
FIG. 14 PRIOR ART
Figure 15:
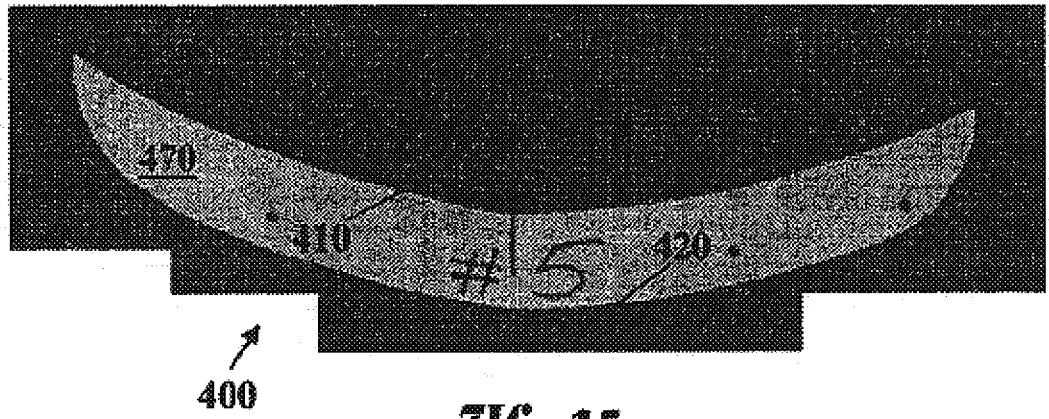
Figure 16:
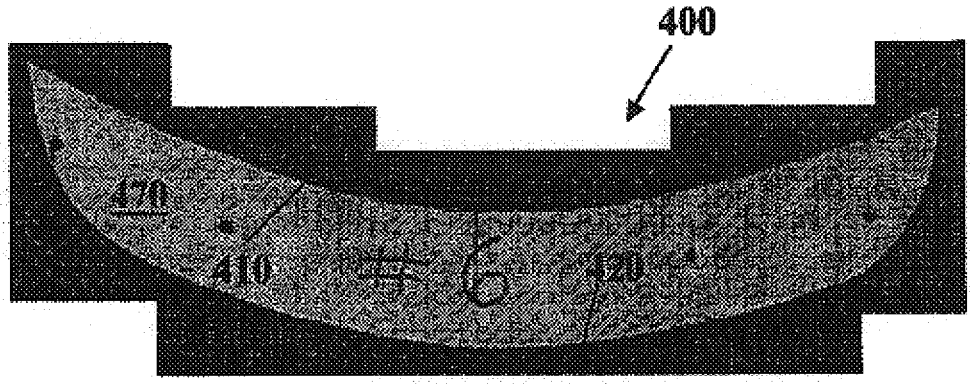
Figure 17:
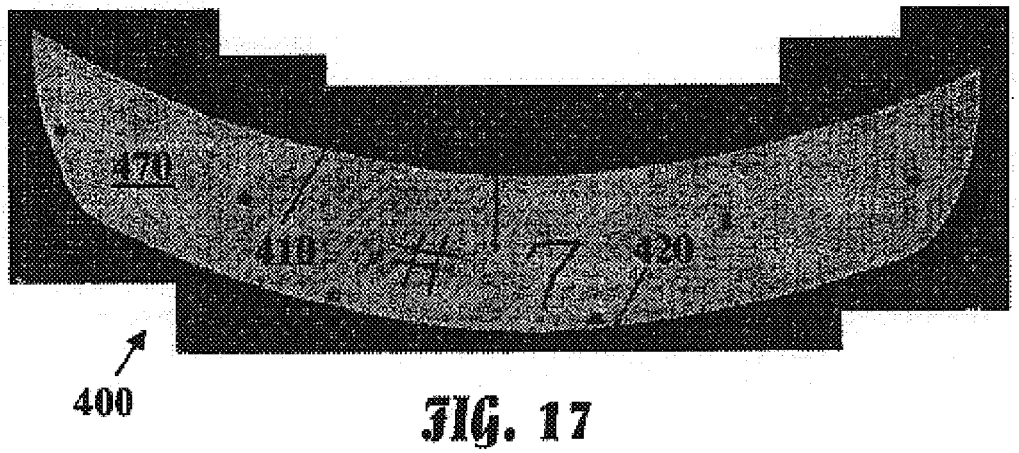
Figure 21:
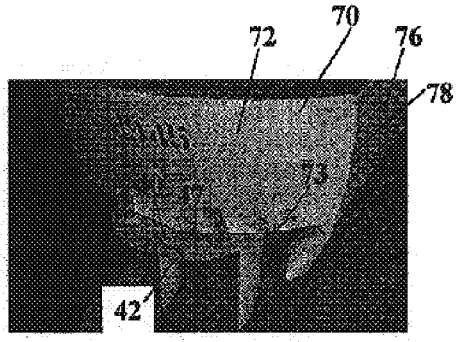

FIG. 21 is a photographic representation, in an upper back perspective view, illustrating installation of the standard stem flap depicted in FIG. 14 with respect to said ship model.

Figure 12:
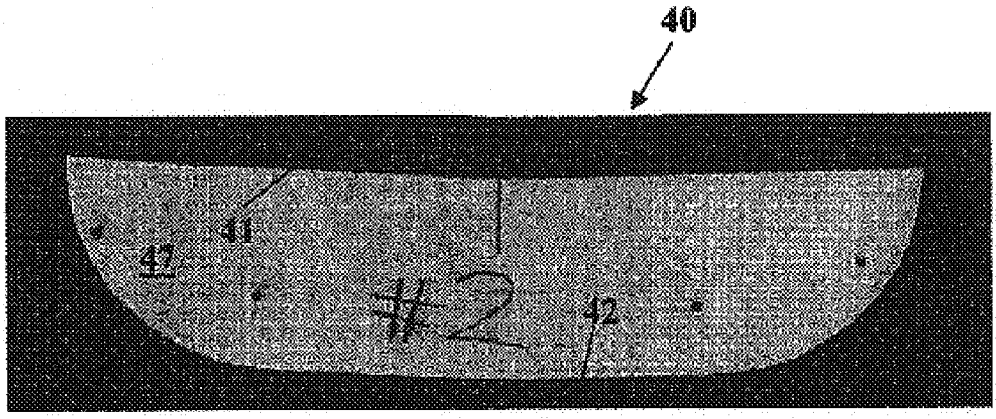
FIG. 12 PRIOR ART
Figure 13:
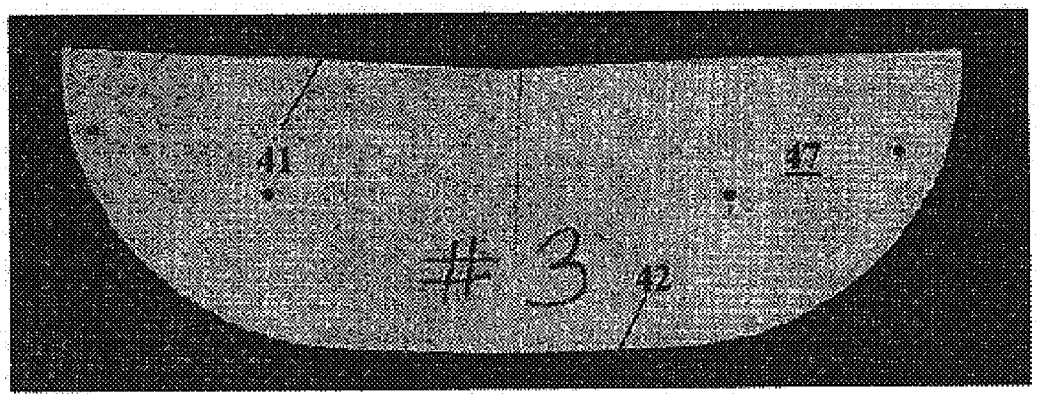
FIG. 13 PRIOR ART
Figure 22:
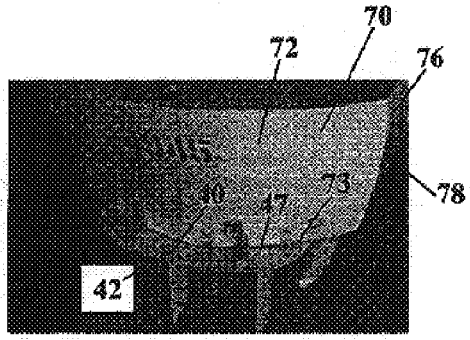

FIG. 22 is a photographic representation, in an upper back perspective view, illustrating installation of the standard stern flap depicted in FIG. 12 with respect to said ship model.

Figure 23:
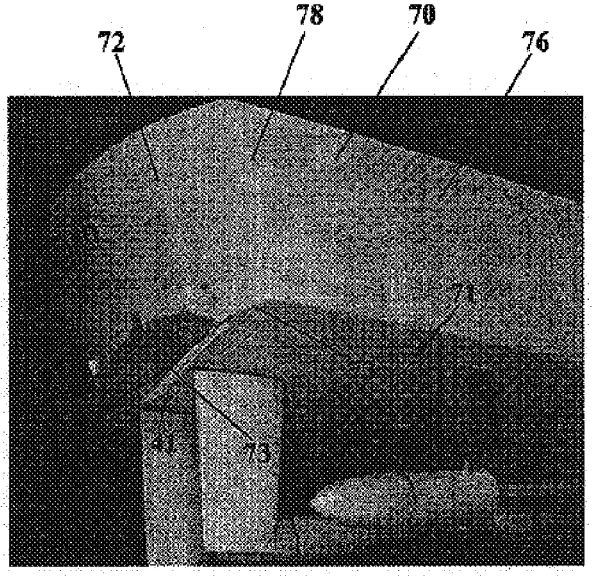

FIG. 23 is a photographic representation, in a lower back perspective view, illustrating installation of the standard stern flap depicted in FIG. 12 with respect to said ship model.

Figure 20:
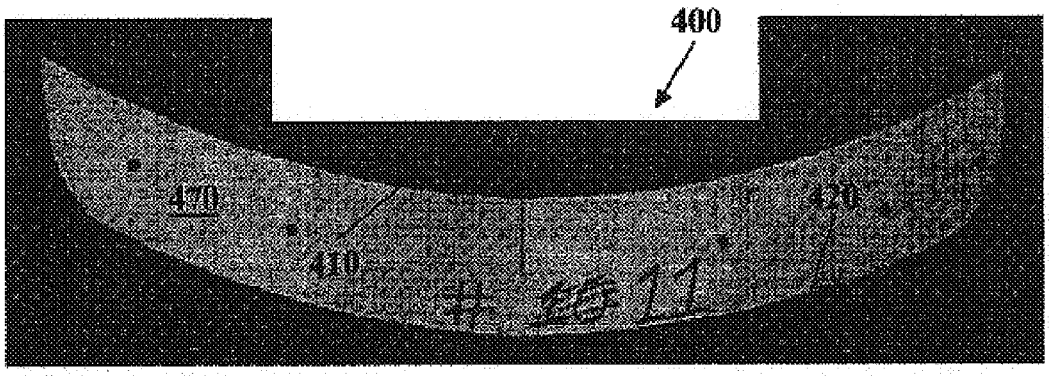
Figure 24:
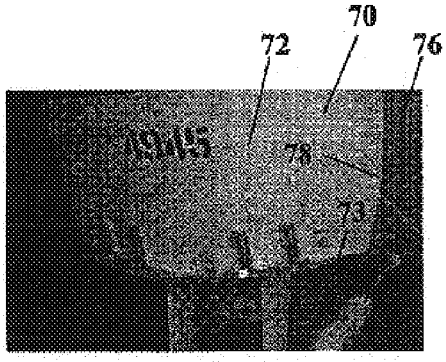

FIG. 24 is a photographic representation, in a back perspective view, illustrating installation of the inventive stern flap shown in FIG. 20 with respect to said ship model.

Figure 25:
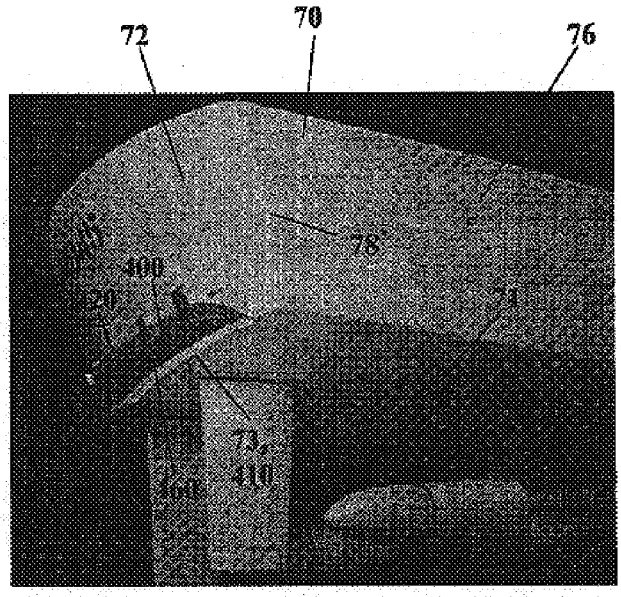

FIG. 25 is a photographic representation, in a lower back perspective view, illustrating installation of the inventive stern flap shown in FIG. 20 with respect to said ship model.

Figure 18:
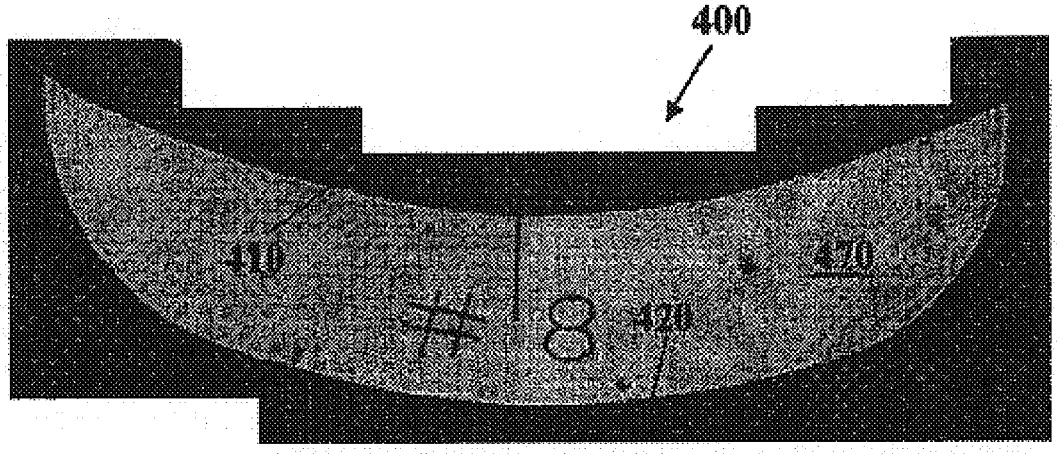
Figure 19:
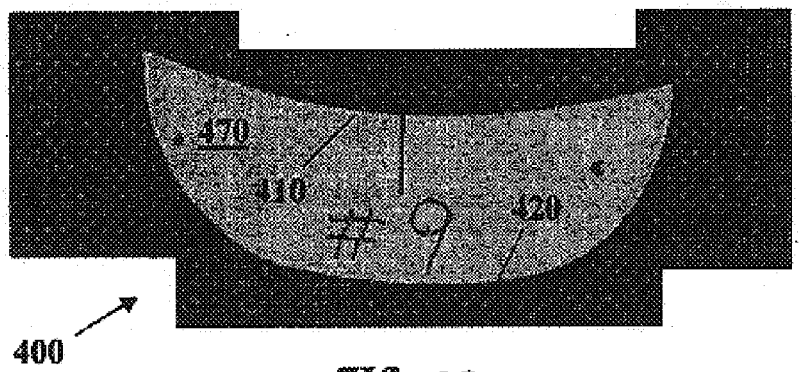
Figure 26:
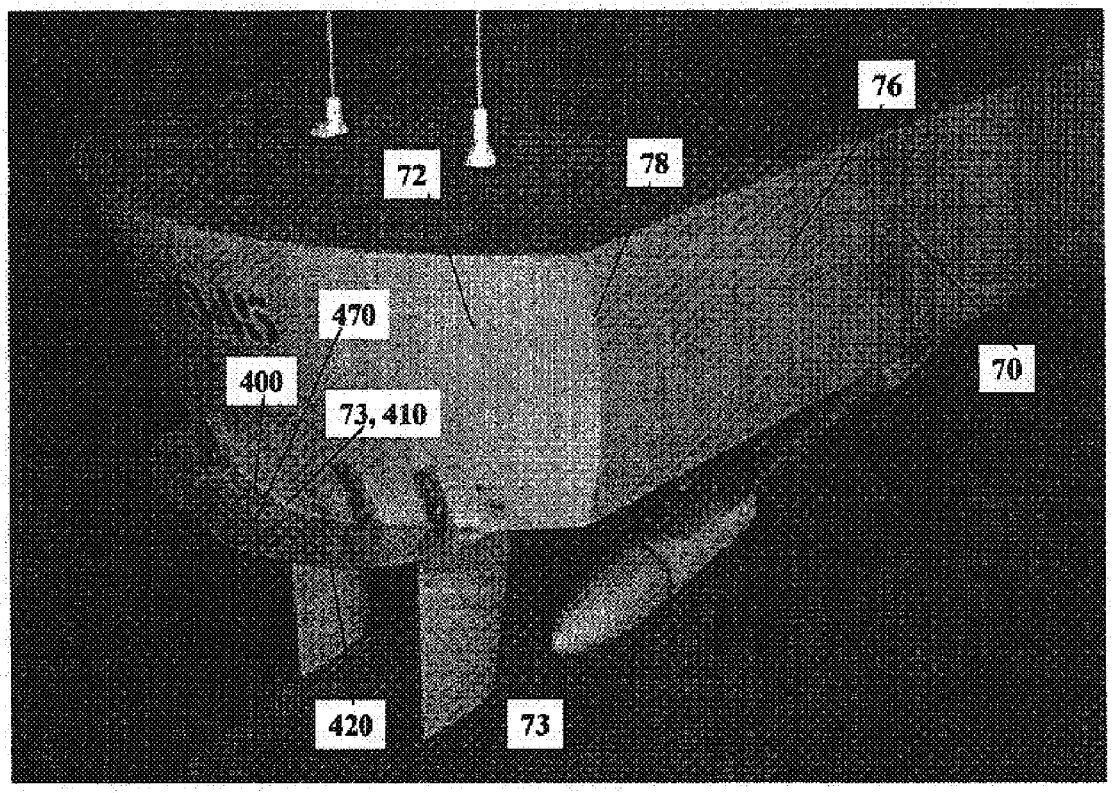

FIG. 26 is a photographic representation, in an upper back perspective view, illustrating installation of the inventive stern flap shown in FIG. 18 with respect to said ship model.

Figure 27:
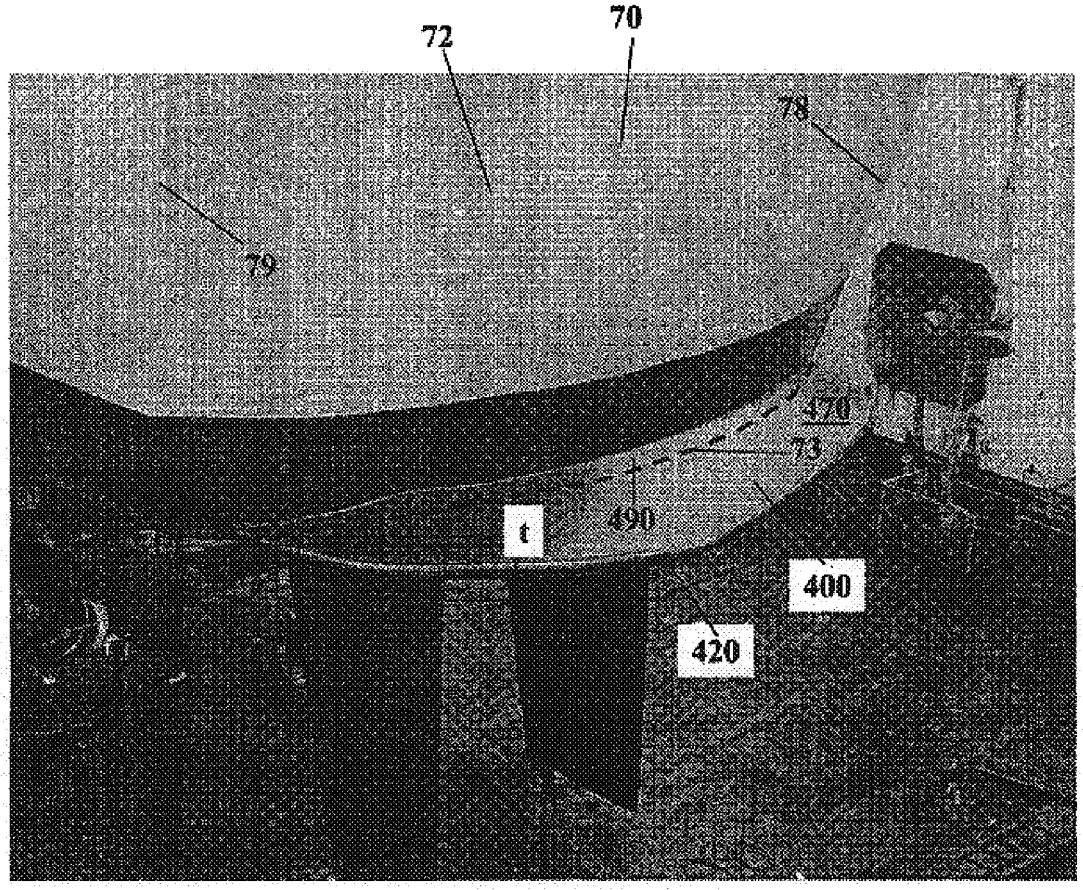

FIG. 27 is a photographic representation, in an upper back perspective view, illustrating installation of an embodiment of an inventive stern flap shown with respect to the U.S. Navy Coast Guard ship WHEC722 MORGENTHAU.

Figure 28:
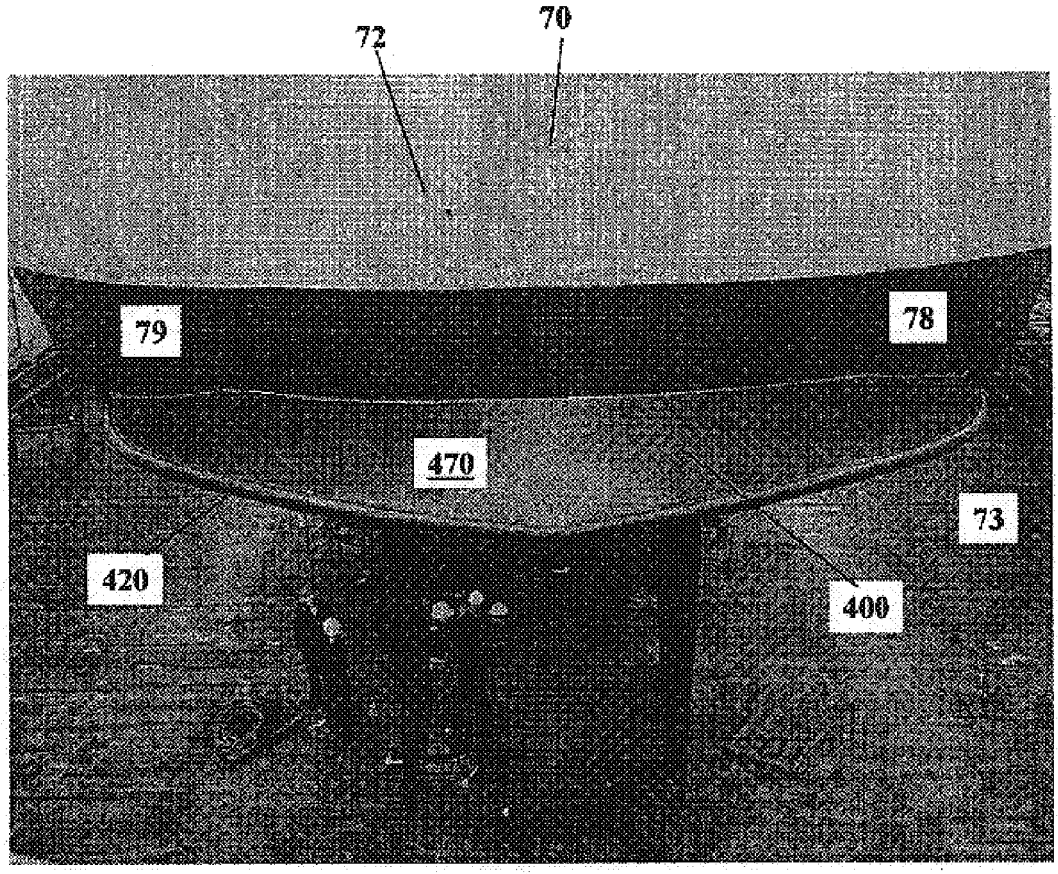

FIG. 28 is a photographic representation, in another upper back perspective view, illustrating the same installation, shown in FIG. 27, of the inventive stern flap embodiment and the U.S. Navy Coast Guard ship WHEC722 MORGENTHAU.

DETAILED DESCRIPTION OF THE INVENTION

Figure 1:
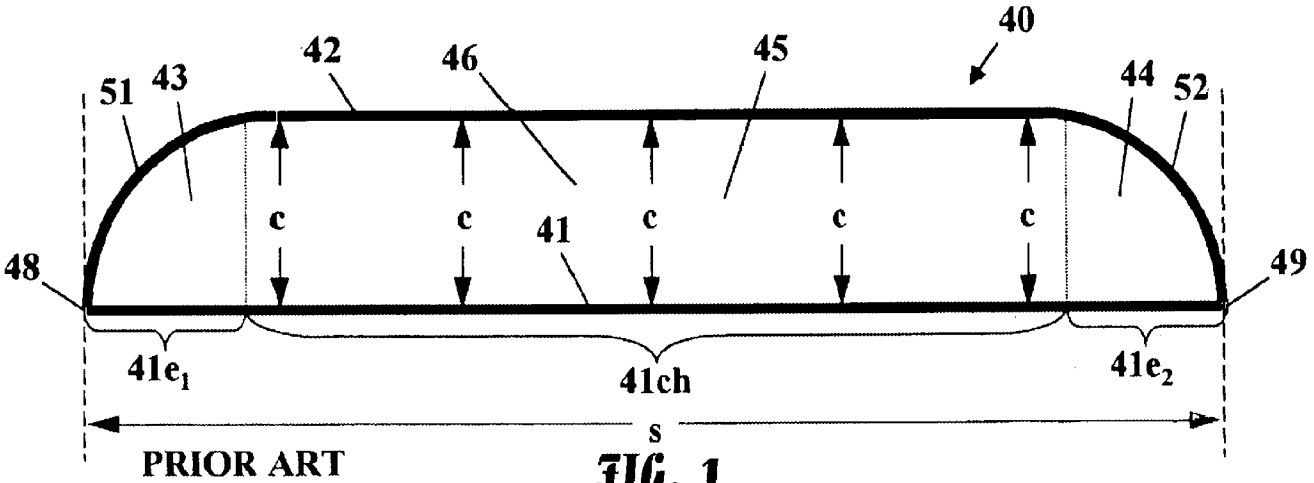
FIG. 1 PRIOR ART
FIG. 1 is a diagrammatic bottom plan view of a standard stem flap, which is characterized by linearity of both the trailing and leading edges.
Figure 2:
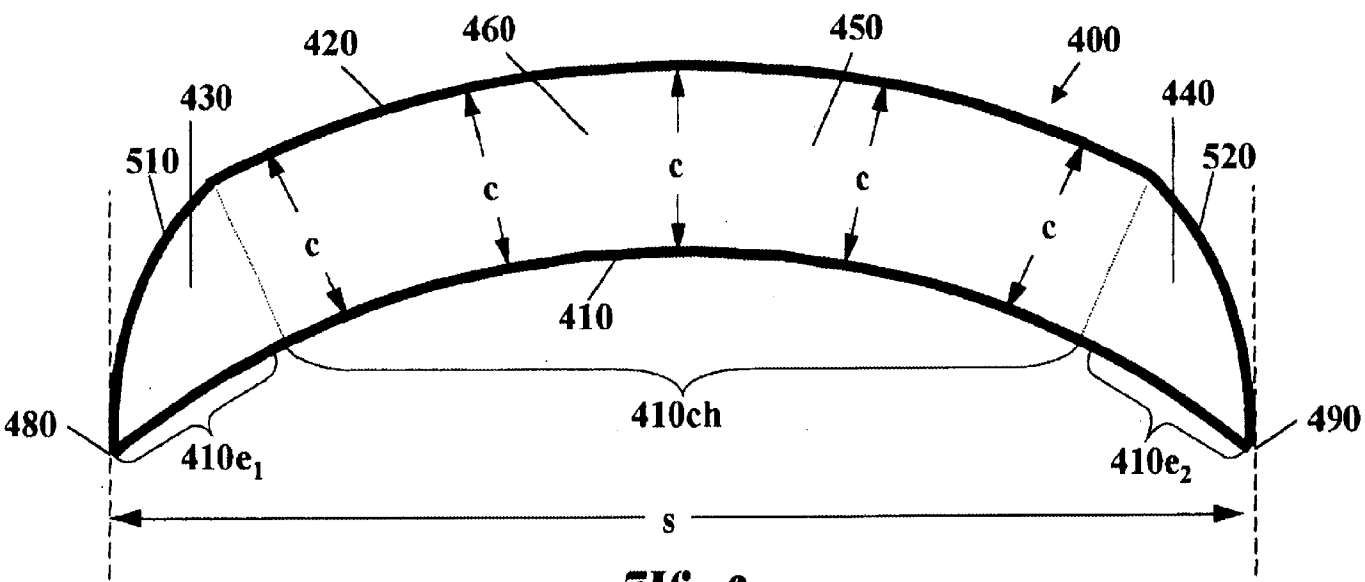
FIG. 2 is a diagrammatic bottom plan view of a stern flap in accordance with the present invention, which is characterized by curvature of both the trailing and leading edges.

Referring now to FIG. 1 and FIG. 2, standard stem flap 40 (shown in FIG. 1) and inventive stern flap 400 (shown in FIG. 2) are characterized by equivalent stem flap span lengths s and are analogous in certain other respects, but have markedly dissimilar geometries.

As shown in FIG. 1, standard stem flap 40 has linear (straight) leading edge 41 and linear (straight) trailing edge 42 which are parallel to each other. Lower flap surface 46 can be geometrically considered to include three surface regions, viz., tapered end surface portions 43 and 44 and a chordal surface portion 45 which is intermediate tapered end surface portions 43 and 44. The two end surface portions 43 and 44 of standard stern flap 40 are curvilinearly tapered, culminating at flap tips (end or extreme points) 48 and 49. Span s is the distance between the tips 48 and 49. Straight leading edge 41 extends from tip 48 to tip 49.

Along its periphery, standard stern flap 40 includes straight leading edge 41, straight trailing edge 42, and curved end edges 51 and 52. Leading edge 41 includes chordal leading edge section 41*ch* and two end leading edge sections 41$e_1$ and 41$e_2$. The section of leading edge 41 which bounds chordal portion 45 is chordal leading edge section 41*ch*. Chordal leading edge section 41*ch* and trailing edge 42 bound chordal portion 45, which constitutes most of lower flap surface 46, and which thus extends over most the span s of standard stern flap 40. The chord length c is constant throughout chordal portion 45.

Chordal leading edge section 41*ch* and trailing edge 42 are not merely parallel, but are parallel in a one-to-one chordal relationship. That is, there is a one-to-one correspondence between the set of points in chordal leading edge section 41*ch* and the set of points in trailing edge 42, such that (at least substantially) every point in either set corresponds with a point in the other set so as to establish (at least approximately) the same chord length c. If trailing edge 42 were imagined to be extended in both directions along its natural straight course, then the two end leading edge sections 41$e_1$ and 41$e_2$ would each be parallel to this extended version of trailing edge 42.

With reference to FIG. 2, the inventive stem flap 400 has a curved leading edge 410 and a curved trailing edge 420 which are in parallel relationship with respect to each other, similarly as the standard stern flap 40 has a linear leading edge 41 and a linear trailing edge 42 which are in parallel relationship with respect to each other. However, inventive stern flap 400 is characterized by a shape which is akin to that of a "boomerang."

The present invention's stem flap 400 has curved leading edge 410 and curved trailing edge 420 which are parallel to each other. Lower flap surface 460 can be geometrically considered to include three surface regions, viz., tapered end surface portions 430 and 440 and a chordal surface portion 450 intermediate end surface portions 430 and 440. The two end surface portions 430 and 440 of standard stern flap 400 are curvilinearly tapered, culminating at tips (end or extreme points) 480 and 490. Span s is the distance between the tips 480 and 490. Curved leading edge 410 extends from tip 480 to tip 490.

Along its periphery, inventive stern flap 400 includes curved leading edge 410, curved trailing edge 420, and curved end edges 51 and 52. Leading edge 410 includes chordal leading edge section 410*ch* and two end leading edge sections 410$e_1$ and 410$e_2$. The section of leading edge 410 which bounds chordal portion 450 is chordal leading edge section 410*ch*. Chordal leading edge section 410*ch* and trailing edge 420 bound chordal portion 450, which constitutes most of lower flap surface 460, and which thus extends over most the span s of standard stein flap 400. The chord length c is constant throughout chordal portion 450.

Chordal leading edge section 410*ch* and trailing edge 420 are not merely parallel, but are parallel in a one-to-one chordal relationship. That is, there is a one-to-one correspondence between the set of points in chordal leading edge section 410*ch* and the set of points in trailing edge 420, such that (at least substantially) every point in either set corresponds with a point in the other set so as to establish (at least approximately) the same chord length c. If trailing edge 420 were imagined to be extended in both directions along its natural curved course, then the two end leading edge sections 410$e_1$ and 410$e_2$ would each be parallel to this extended version of trailing edge 420.

Figure 3:
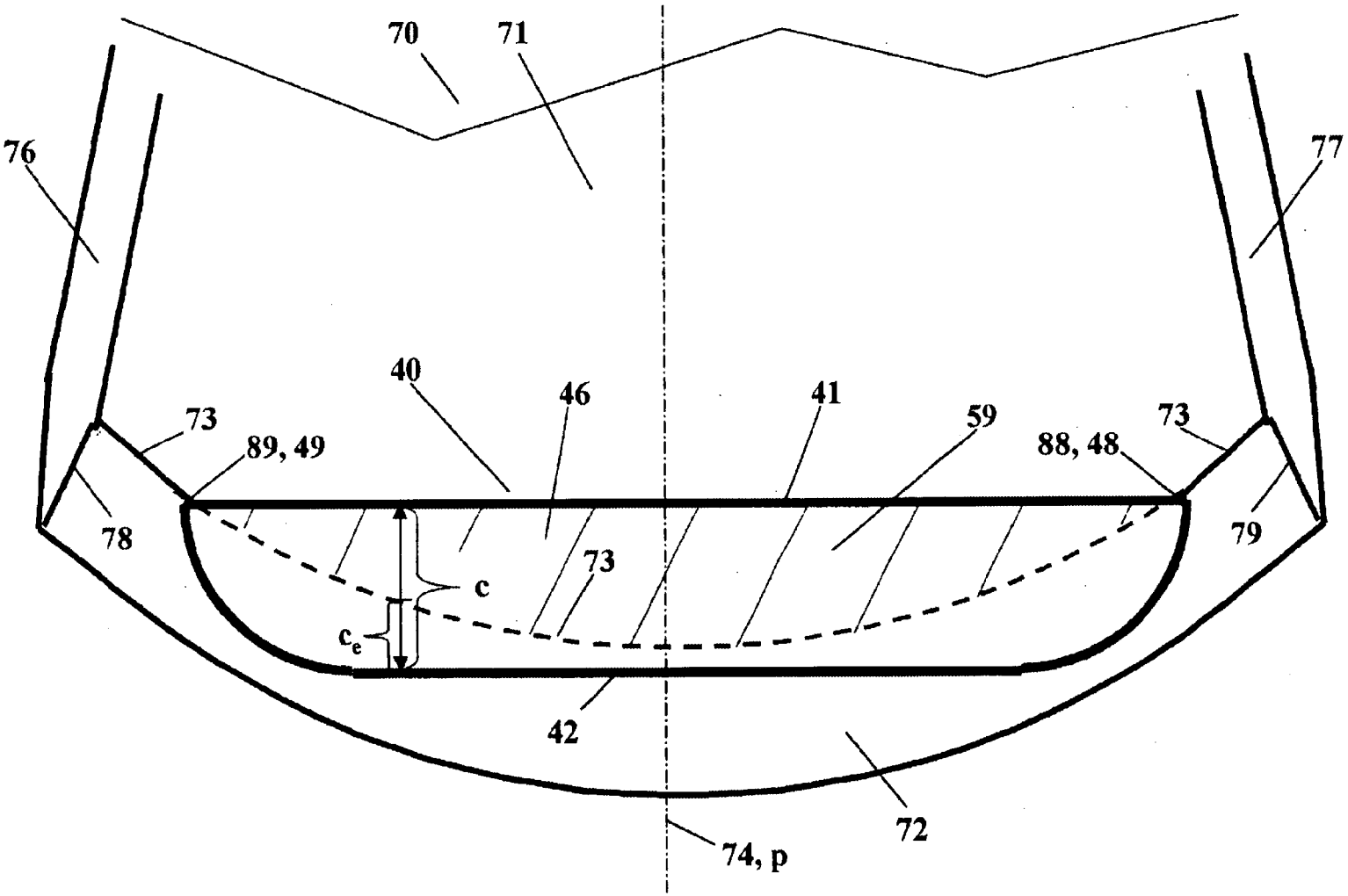
FIG. 3 is a diagrammatic bottom plan view of a representative marine vessel (partially shown) and a standard stern flap such as that shown in FIG. 1, wherein the standard stem flap is shown coupled with the vessel so as to be partially recessed below and forward of the transom, so that the two tips of the standard stem flap approximately coincide with two corresponding points of the transom knuckle.
Figure 4:
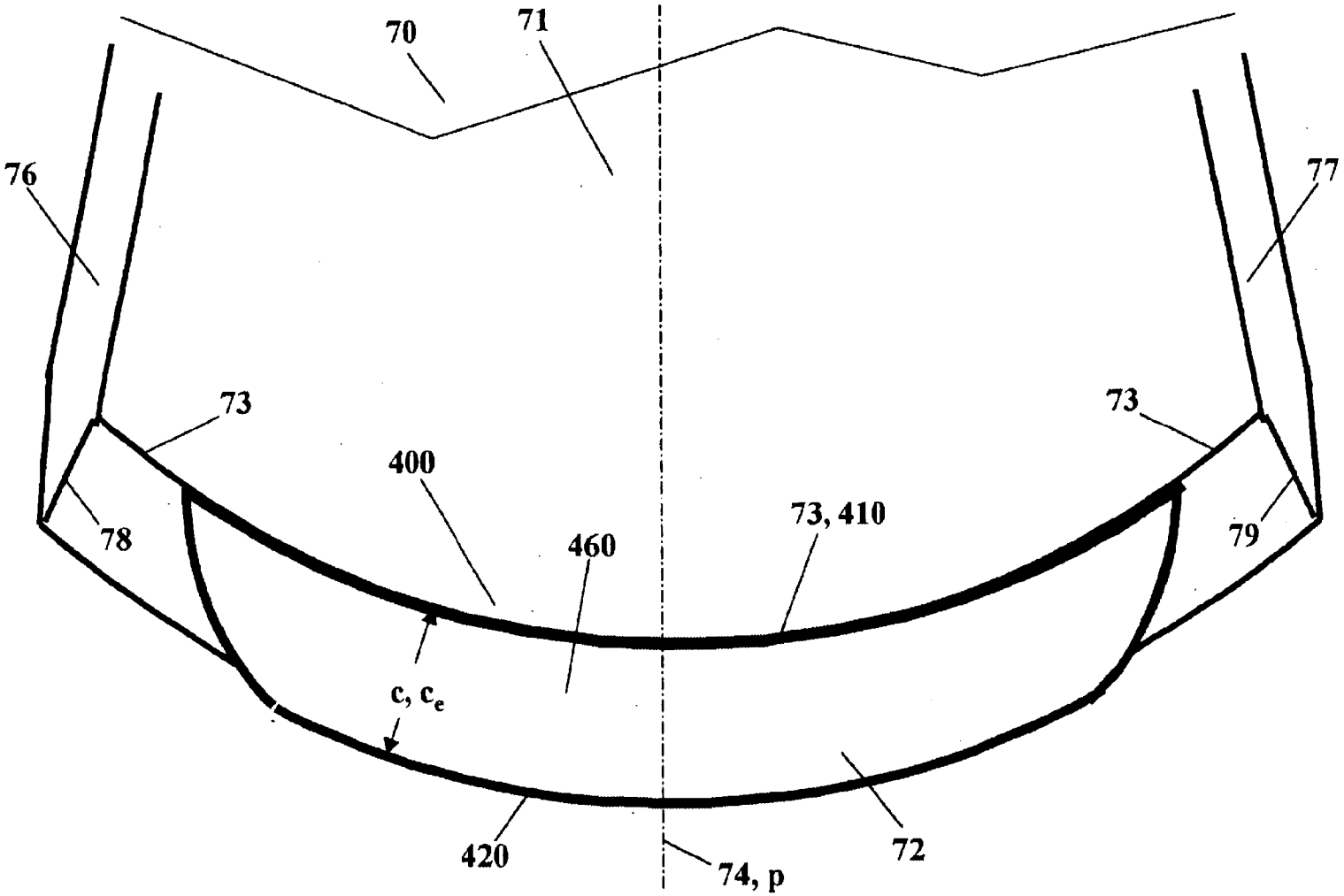
FIG. 4 is a diagrammatic bottom plan view of a representative marine vessel (such as partially shown in FIG. 2) and an embodiment of an inventive stern flap such as that shown in FIG. 2, wherein the inventive stem flap is shown coupled with the vessel at the transom knuckle.

Reference now being made to FIG. 3, FIG. 4 and FIG. 5, hull 70 includes a hull bottom 71, a transom 72, a starboard side 76 and a port side 77. Transom 72 is a laterally curved transom 72 which meets hull bottom 71 at a laterally curved knuckle 73. Transom 72 meets starboard side 76 at starboard transom edge 78, and meets port side 77 at port transom edge 79. Transom knuckle 73 is the transom's lower seam or edge—i.e., the seam or edge formed at the junction of hull bottom 71 and transom 72, resulting from the different respective angularities or orientations of the hull bottom 71 surface and the transom 72 surface.

Centerline 74 is an imaginary geometric line which can be conceived to extend longitudinally through hull 70 whereby an imaginary vertical geometric plane p passing therethrough bisects hull 70 into two approximately equal halves, viz., a starboard half and a port half. Standard stern flap 40 and inventive stern flap 400 analogously exhibit symmetry with respect to plane p. As shown in FIG. 3, standard stern flap 40 is symmetrical about plane p, and standard stern flap tips 48 and 49 are equidistant from plane p. Similarly, as shown in FIG. 4, inventive stern flap 40 is symmetrical about plane p, and inventive stern flap tips 480 and 490 are equidistant from plane p.

Generally speaking, the objective of installing a stern flap onto a marine vessel is to effectively extend the hull's underside so as to impart favorable hydrodynamic characteristics to the marine vessel. This goal is best achieved if the hull's lower surface and the stern flap's undersurface are connected so as to essentially establish a surface continuity, without gaps or breaks. With these considerations in mind, it is seen in FIG. 3 that a standard stern flap such as standard stem flap 40 shown in FIG. 1 is not well suited for installation onto a hull having a curved transom, such as the hull 70 having curved transom 72 portrayed in FIG. 3 and FIG. 4.

As shown in FIG. 3, by necessity, due to the rectilinear geometry of standard stem flap 40, a substantial part of standard stem flap 40 must be recessed beneath hull bottom 71 and hence be rendered less useful or nonuseful, or less influential or noninfluential (at least, in a positive way), for hydrodynamic purposes. This substantial "wasted" part of standard stern flap 40 includes unused lower surface portion 59, which is bounded fore by actual leading edge 41 and aft by transom knuckle 73 (transparently represented by a curved dashed line), and which laterally extends between transom knuckle location 89 (with which standard stern flap tip 49 is approximately coincident) and transom knuckle location 88 (with which standard stem flap tip 48 is approximately coincident).

The standard stem flap 40 shown in FIG. 1 and FIG. 3 includes a lower standard stern flap surface 46 and an upper standard stern flap surface 47. Upper standard flap surface 47 is not actually shown in FIG. 1 and FIG. 3, but is easily conceived to be on the upper side of standard flap 40, i.e., the side opposite lower standard flap surface 46 (See, e.g., FIG. 11 through FIG. 14 for photographic views of upper surfaces of various standard stem flaps used in model testing by the U.S. Navy). The inventive stern flap 400 shown in FIG. 4 and FIG. 5 includes a lower inventive stern flap surface 460 and an upper inventive stern flap surface 470.

The deficiency of standard stem flap 40 in association with curved transom 72 can be explained in terms of the distinction in meaning between (i) the actual (that is, in terms of its own intrinsic structural form) chord length c of a stem flap and (ii) the effective chord length $c_E$ of a stern flap. The "actual" chord length c is the chord length in terms of the stern flap's own intrinsic structural form. The "effective" chord length $c_E$ is the chord length in terms of the area of the stem flap which, when implemented, acts in a hydrodynamically influential manner. The actual chord length c is the distance between the leading edge and the trailing edge of the stem flap, such distance taken along the lower surface of the stern flap. The effective chord length $c_E$ is the distance perpendicular to the transom knuckle and between the transom knuckle and the trailing edge of the stem flap, such distance taken along the lower surface of the stern flap.

It is noted that measurement of a chord length, whether actual chord length c or effective chord length $c_E$, is over a geometric straight line which is the shortest distance between two corresponding geometric points (a leading edge 410 point—in particular, a chordal leading edge section 410*ch* point—and a corresponding trailing edge 420 point, in the case of actual chord length c; a transom knuckle 73 point and a corresponding trailing edge 420 point, in the case of effective chord length $c_E$). Since, depending on the inventive embodiment, the lower flap surface 460 may not be perfectly flat (planar), it can be considered that a chord length lies in a geometric "plane" (planar configuration) which is described by lower flap surface 460 (in particular, chordal surface 450) and which is flat in the direction between the set of forward geometric points on the front edge (leading edge 410—in particular, chordal leading edge section 410*ch*—in the case of actual chord length c; transom knuckle 73, in the case of effective chord length $c_E$) and the set of corresponding geometric points on the back edge (trailing edge 420).

The word "tangent" means making contact ("touching" but not intersecting) at a single point. In geometry, "tangent" refers to meeting a curve or surface at a point and being characterized, at that point, by the same direction as the curve or surface being met. A line, curve or surface can be tangent to another line, curve or surface. At every point on the curved chordal leading edge section 410*ch*, there exists a straight line (or flat plane) tangent thereto having a corresponding straight line (or flat plane) which is parallel thereto and which is tangent to a point on the trailing edge 420. The chord length c is the perpendicular distance between these two corresponding points, one point on each curve.

As shown in FIG. 3, the actual chord length c of standard stem flap 40 is not nearly the same as (in fact, is considerably greater than) its effective chord length $c_E$. In contrast, as shown in FIG. 4, the actual chord length c of inventive stern flap 400 is exactly the same (or at least approximately so, given the possibility of minor practical inexactitudes attendant stern flap installation) as the effective chord length $c_E$.

It is thus seen that the configuration shown in FIG. 3 makes significantly less than full use of the standard stem flap's flap surface area and flap chord length, whereas the inventive configuration shown in FIG. 4 does indeed make full use of the inventive stern flap's flap surface area and flap chord length.

As shown in FIG. 4 and FIG. 5, leading edge 410 of inventive stern flap 400 is congruent, or at least approximately so, with a sizable intermediate portion of transom knuckle 73. Since transom knuckle 73 and leading edge 410 describe the same curvature, they are able to flushly mate with each other. When inventive stem flap 400 and hull 70 are coupled, transom knuckle 73 and leading edge 410 adjoin or abut so that hull bottom 71 and lower flap surface 460 are at least approximately even with each other, lower flap surface 460 thereby effectively constituting an extension of hull bottom 71.

Thus, according to typical inventive embodiments, inventive flap 40 is coupled with hull 70 so that its leading edge 410 and the transom knuckle 73 (or a significant middle portion of transom knuckle 73) are at least substantially adjacent, thereby generally establishing a continuity between the hull bottom 71 surface and the lower flap surface 460. An inventive stern flap 400 configuration such as shown in FIG. 4 provides for a smooth transition between hull bottom 71 and lower inventive flap surface 460. By comparison, in actual fill-scale practice, a standard stern flap configuration such as shown in FIG. 3 might necessitate more intricate welding or other technique involved in manufacturing or installation in order to achieve an appropriately smooth transition between hull bottom 71 and lower standard flap surface 46.

Generally, the hydrodynamically significant surface (the "working" surface) of a stern flap is its lower flap surface; its upper flap surface is hydrodynamically insignificant, albeit it may be structurally significant. In other words, the lower flap surface, not the upper flap surface, interacts with the water in which the marine vessel is situated. The present invention's contour stem flap thus affords enhanced performance, vis-a'-vis the standard stern flap, when used in association with marine vessels having laterally curved stems.

In the case of standard stem flap 40, lower flap surface 46 is the hydrodynamic surface of standard stem flap 40. Similarly, in the case of inventive stem flap 400, lower flap surface 460 is the hydrodynamic surface of inventive stern flap 400. The actual chord length c and the effective chord length $c_E$ of standard stern flap 40 are each taken along its lower flap surface 46, or along the imaginary plane described by its lower flap surface 46. Similarly, the actual chord length c and the effective chord length $c_E$ of inventive stern flap 400 are each taken along its lower flap surface 460, or along the imaginary plane described by its lower flap surface 460.

In inventive practice, it will frequently be the case that certain areas of lower flap surface 460 are hydrodynamically more significant than others in certain respects. For instance, it may be that the lower flap surface's chordal surface portion 450 is more significant insofar as serving a hydrodynamic hull-extensive purpose than the lower flap surface's two end surface portions 430 and 440, which serve more of a hydrodynamic fairing purpose. Accordingly, depending on the inventive embodiment, it may be more important for chordal leading edge section 410*ch* to hug transom knuckle 73, than for the two end leading edge sections 410$e_1$ and 410$e_2$ to hug transom knuckle 73. In other words, the "conformal" quality (relative to transom knuckle 73) of leading edge 410 may be most important in chordal leading edge section 410*ch*.

The present invention thus represents a new, "contour" stem flap design, initially motivated by the U.S. Coast Guard's desire to install a stern flap onto a nautical vehicle having a highly curved transom, a job for which the U.S. Coast Guard sought the U.S. Navy's assistance. The present invention's contour stem flap 400 configuration allows for the leading edge 410 of the inventive stern flap 400, over the entire flap 400 span s, to coincide with the transom knuckle 73 along the transom 72 radius of curvature described by the transom knuckle 73. The contour stern flap trailing edge 420 is also designed to match this transom 72 curvature, in particular the curvature of the lower transom 72 edge, viz., transom knuckle 73.

Therefore, with both the leading edge 410 and the trailing edge 420 of inventive stern flap 400 matching the transom knuckle 73 radius of curvature, not only a constant actual chord length c, but also a constant effective chord length $c_E$ (which is measured perpendicular to the transom knuckle 13), can be maintained. Contrastingly, notwithstanding the constant actual chord length c of standard stern flap 40, since neither the leading edge 41 nor the trailing edge 42 of standard stern flap 40 matches the transom 72 radius of curvature, the effective chord length $c_E$ (which is measured perpendicular to the transom knuckle 73) is shortened (varyingly along span s), and standard stern flap 40 is thus largely devalued as a hydrodynamic adjunct.

The important criteria for practice of most embodiments of the present invention are "edge conformity" and "chord uniformity." The chord uniformity entails both actual chord uniformity and effective chord uniformity. By way of explanation, in accordance with typical practice of the present invention, each of the following is a sine qua non of inventive practice: (i) the inventive stem flap's leading edge at its lower surface at least approximately conforms with the hull's lower stern edge (e.g., bottom transom edge, or transom knuckle); (ii) the inventive stern flap's actual chord length at least approximately equals the effective chord length, and is at least approximately constant, at at least substantially every point along the inventive stern flap's span length which manifests such constancy (According to typical embodiments, such chord length constancy would essentially be manifested along chordal surface portion 450—i.e., along the entire span length s of the stern flap 400 lower surface 460, save the two end or tip sections 430 and 440). These criteria are interrelated in inventive principle since, assuming proper inventive installation of the inventive stern flap, edge conformity and actual chord uniformity imply effective chord uniformity, or, conversely, edge conformity and effective chord uniformity imply actual chord uniformity.

As illustrated by way of example in FIG. 5 through FIG. 8, in accordance with multifarious embodiments of the present invention, the lower stern flap surface 460 can be perturbed practically any which way, so long as the above-described conditions of edge conformity and chord uniformity obtain. As shown in FIG. 4, FIG. 5 and FIG. 6, representative of many embodiments of the present invention, lower surface 460 of inventive stern flap 400 describes a "Euclidean" (flat or linear) geometric plane which is coplanar with the flat geometric plane described by transom knuckle 73 and which is coplanar with the "Euclidean" (flat or linear) geometric plane described by hull bottom 71.

However, according to inventive practice, it is not necessary that the inventive stern flap's lower surface lie in a single flat plane, nor is it necessary, according to inventive practice, that the transom knuckle lie in a single flat plane; nor is it necessary, according to inventive practice, that the inventive stem flap's lower surface lie in the same plane in which the transom knuckle lies; nor is it necessary, according to inventive practice, that the inventive stern flap's lower surface lie in the same plane in which the hull bottom lies. Regardless of the degree and kind of perturbation, or lack thereof, of inventive stern flap lower surface 460, every inventive stern flap 400, when viewed in elevation straight-on from aft of the transom 72, will manifest nonconstancy (variability) of angularity of the chord angles. For instance, as viewed in FIG. 6 through FIG. 8, the angle of chord c into the sheet of paper on which the figure is drawn depends upon the point along span c at which chord c is measured.

Due to architectural and/or hydrodynamic considerations, it may be desirable to practice the present invention whereby the lower flap surface 46 of inventive stem flap 400 is nonplanar and/or generally describes a downwardly oblique angle with respect to centerline 74 (that is, wherein the TED angle, shown as flap angle a in FIG. 5, is greater than zero). By way of illustration, let us begin with a plate-like inventive stern flap having two parallel surfaces, i.e., both a flat top surface and a flat bottom surface which are parallel to each other. An example of such as flat plate-like inventive stem flap 400 is shown in FIG. 4 through FIG. 6, which has flat lower surface 460 and flat upper surface 470. Then, with reference to FIG. 7 and FIG. 8, let us imagine bending that flat plate-like inventive stem flap. If we bend the flat plate-like inventive stem flap in the middle (mid-span), we have an inventive stern flap manifesting a V-shaped profile such as that shown in FIG. 7. This type of V-shaped profile is also revealed herein in some photographic views of inventive stem flap embodiments (FIG. 15 through FIG. 20 and FIG. 24 through FIG. 26). If we bend the flat plate-like inventive stern flap upward toward the extremities so as to manifest a vertical curvature, we have an inventive stem flap such as that shown in FIG. 8.

In both FIG. 7 and FIG. 8, in keeping with inventive principles applicable to inventive practice in general, the following conditions obtain with regard to inventive stern flap 400: stern flap leading edge 410 is at least approximately conformal with respect to transom knuckle 73; stern flap 400 is at least approximately uniform in actual chord length c (measured as the perpendicular distance along lower flap surface 760, or along the geometric plane defined thereby, between the leading edge 410 and the trailing edge 420); stern flap 400 is at least approximately uniform in effective chord length $c_E$ (measured as the perpendicular distance along lower flap surface 760, or along the geometric plane defined thereby, between the transom knuckle 73 and the trailing edge 420); stem flap 400 is at least approximately uniform collectively in terms of both actual chord length c and effective chord length $c_E$ (in other words, the actual chord lengths c and the effective chord lengths $c_E$ are at least approximately equal to each other at at least substantially every point along span s corresponding to a chord distance).

Nevertheless, the inventive stern flaps 400 shown in FIG. 7 and FIG. 8 are distinguishable. Inventive stem flap 400 shown in FIG. 7 essentially lies in two nonhorizontal flate (Euclidean) planes which meet at a small angle at a medial stern flap crease 480. Inventive stern flap 400 shown in FIG. 8 essentially lies in a curved (non-Euclidean) plane which meet at a small angle at a medial stern flap crease 480. The inventive stern flaps 400 shown in FIG. 7 and FIG. 8 share another characteristic: The profile or planar definition of lower flap surface 760, when viewed from the back of transom 72, is coincident with that of transom knuckle 73.

It is useful in naval architecture to conceive of a hull's centerline as being a local buttock centerline—that is, as describing the slope (or "run") of the buttock proceeding forward from the transom. As shown in FIG. 5, hull bottom 71 is essentially flat and horizontal, and hence local buttock centerline 74 is horizontal. In this example, lower flap surface 46 of inventive stern flap 40 effectively constitutes an extension of hull bottom 71 whereby lower flap surface 46 is essentially flat and horizontal, and therefore the angle referred to as the "trailing edge down" (abbreviated "TED") is zero. Also as shown in FIG. 5 via dashed lines, a different hull bottom, viz., hull bottom 71' having local centerline 74', is sloped aftwardly upward so that flap angle $\alpha$ is greater than zero. The trailing edge down (TED) angle is indicated as flap angle $\alpha$, which is referenced to the slope of local centerline 74.

Thus, the present invention can be practiced not only in embodiments wherein the lower flap surface 46 of inventive stern flap 400 is disposed at a zero TED angle, but also in embodiments wherein inventive stem flap 400 is disposed at an acute TED angle (referenced to the local buttock centerline 74 slope/run at the transom 72). As shown in FIG. 6 by dashed line indicated as lower flap surface edge 710', an inventive stern flap's bottom surface 760 can be disposed downward relative to transom knuckle 73 so as to generally or roughly describe a shape comparable to that of a portion of a geometric cone. As shown in FIG. 6 through FIG. 8, the profile or planar definition of lower flap surface 760', when viewed from the back of transom 72, is not coincident with, and is in fact below, that of transom knuckle 73.

As variously shown in FIG. 5 through FIG. 8, inventive stem flap 400 is characterized by a flap thickness t, which generally represents the distance between lower flap surface 460 and upper flap surface 470. The inventive stern flap 400 embodiment having lower flap surface 460, as shown in FIG. 5 and FIG. 6, is constant in thickness t, since the inventive stern flap 400 essentially represents a plate shape having two parallel opposite surfaces 460 and 470. The inventive stem flap 400 embodiments having lower flap surface 460, as shown in FIG. 7 and FIG. 8, similarly manifest constancy in thickness t, albeit their profiles are not flat plate shapes. As shown by alternative upper flap surfaces 470' and 470" in FIG. 8, depending on the inventive embodiment, the upper flap surface 420 can vary and hence the thickness t vary in accordance therewith.

Generally speaking, regardless of the inventive embodiment, inventive stern flap 400 will include a two-dimensional stem flap leading surface 490 which is characterized by a thickness t (not necessarily the same thickness t as existing at any or all other locations in inventive stern flap 400) and which is demarcated below by leading edge 410. Therefore, according to inventive practice, it will usually not be sufficient that leading edge 410 be conformal with respect to transom knuckle 73; it will additionally be necessary that a two-dimensional stem flap leading surface 490 itself be conformal with respect to the entire portion of transom 72 which inventive stem flap 400 is designed to adjoin or abut, including transom knuckle 73 and the pertinent vicinity thereabove (e.g., a two-dimensional stern flap leading surface 490 which is characterized by a thickness t, such as shown in FIG. 27) of transom 72.

In the light of the instant disclosure, the ordinarily skilled artisan will be capable of practicing the present invention in any of a variety of embodiments. Moreover, in the light of the instant disclosure the ordinarily skilled artisan will be capable of evaluating how to practice the present invention in a beneficial manner, in terms of performance, for a given application. Generally speaking, key parameters affecting the performance of a stern flap include chord length, span length, TED angle (angle relative to the buttock lines, e.g., buttock centerline), planform shape and thickness shape. Among the possible special considerations regarding shape are the configurational fairing details (e.g., at outboard locations in the vicinity of the transom knuckle).

Referring to FIG. 9 and FIG. 10, the present invention admits of application to curved stems having practically any degree of curvature. The inventive stern flap 400 can have a leading edge 410 characterized by a curvature, suitable for accommodating a given transom knuckle 73, ranging from great curvature (such as exemplified in FIG. 9) to slight curvature (such as exemplified in FIG. 10). In inventive practice, the degrees of curvature can be even more extreme than those shown in FIG. 9 and FIG. 10.

Reference is now made to FIG. 11 through FIG. 26. Initial investigation of the present invention's contour stern flap concept was conducted at model scale in July 2000 by the present inventor as a civilian employee of the U.S. Navy. Performance of the inventive stern flap 400 was compared with that of the standard stern flap 40. These model-scale experiments demonstrated that, when tested in association with the same subject hullform 70, the performance of the present invention's new contour stern flap 400 shape exceeded that of the standard stem flap 40 shape. The four standard stern flap 40 designs which were tested in these experiments are depicted in FIG. 11 through FIG. 14. The six inventive stern flap 400 designs which were tested in these experiments are depicted in FIG. 15 through FIG. 20.

Although the standard stem flaps 40 shown in FIG. 11 through FIG. 14 had perfectly straight leading edges ;41 and trailing edges 42 (which were parallel to each other), these edges 41 and 42 do not appear to be perfectly straight in these photographic perspectives. This is because the model hull 70 used for the experiments was characterized by a moderately "V-shaped" hull bottom 71 and transom 72, similar to hull bottom 71 and transom 72 shown in FIG. 7. Hence, since the photographs were not taken perfectly in "plan," (e.g., from a perfectly vertical perspective), the V-shape crookedness of the standard flap lower surface 46 is revealed. This type of V-shape crookedness is also manifest in the inventive flap lower surfaces 460 shown in FIG. 15 through FIG. 20.

Model hull 70 is a scaled-down version of a full-scale hull 70 having a transom 72 width (full span) of about 28.2 feet. As shown in FIG. 21 through FIG. 23, each standard stern flap 40 was recesses beneath the model hull bottom 71 in order to accommodate the curvature of the model's transom knuckle 73. The standard stern flap 40 shown in FIG. 14 and FIG. 21 had a relatively "small" span of about 15.9 feet (in terms of corresponding full-scale ship dimensions). The standard stern flap 40 shown in FIG. 12, FIG. 22 and FIG. 23 had a relatively "mid-sized" span of about 22.0 feet (in terms of corresponding full-scale ship dimensions). Similarly as described herein with reference to FIG. 3, this recessing of each of the standard stem flaps 40 resulted in significantly decreased surface area utilization of the stem flap lower surface 46. Each standard stern flap 40' had an effective chord length $c_E$ which was considerably less than its actual chord length c., In contrast, as shown in FIG. 24 through FIG. 26, the actual chord length c of inventive stem flap 400 equals the effective chord length $c_E$. The inventive stern flap 400 shown in FIG. 20, FIG. 24 and FIG. 25 had a relatively "large" span of about 25.0 feet; the inventive stem flap 400 shown in FIG. 18 and FIG. 26 had a relatively "mid-sized" span. Hence, as distinguished from standard stern flap lower surface 46 shown in FIG. 21 through FIG. 23, the entirely of inventive stern flap lower surface 460 shown in FIG. 24 through FIG. 26 is hydrodynamically useful. In the practice of these experiments, white tape was used to bridge any small gaps or discontinuities between an inventive leading edge 410 and the hull 70 model's transom knuckle 73, and to create smooth transitions between a standard flap lower surface 41 and the hull 70 model's bottom 71.

With reference to FIG. 27 and FIG. 28, further experiments pertaining to the present invention were conducted in January 2002, this time at full scale. The WHEC722 MORGENTHAU was assigned by the U.S. Coast Guard as the test ship for the present invention's contour stem flap. Full-scale at-sea speed/power trials were performed "pre-flap" (i.e., with respect to the ship in the absence of any flap) and "post-flap" (i.e., with respect to the ship having attached thereto an inventive stern flap 400). The speed/power trials were conducted on MORGENTHAU under the direction of the U.S. Coast Guard, Naval Architecture Branch, based on recommendations made by the present inventor.

In these full-scale experiments, an initial full-scale at-sea speed/power trial was performed on the baseline ("pre-flap") ship. Subsequently, an inventive contour stern flap 400 was installed on MORGENTHAU during a dry-dock period in October-November 2001, as depicted in FIG. 27 and FIG. 28. A "post-flap" full-scale at-sea speed/power trial was then performed in January 2002. Preliminary results of the pre-flap and post-flap trials on MORGENTHAU indicate that the inventive contour stern flap 400 has associated therewith an eleven and one-half percent (11.5%) reduction in power with a corresponding eight and one-half percent (8.5%) fuel savings. In addition, Coast Guard officers (specifically, the captain and the engineering officer) aboard MORGENTHAU were very pleased with how well the inventive stem flap 400 worked and how smoothly the MORGENTHAU ship 70 ran.

Other embodiments of this invention will be apparent to those skilled in the art from a consideration of this specification or practice of the invention disclosed herein. Various omissions, modifications and changes to the principles described herein may be made by one skilled in the art without departing from the true scope and spirit of the invention which is indicated by the following claims.

What is claimed is:

1. For use in association with a nautical vehicle including a stern and bottom, said stern and bottom forming a crosswise junction, said crosswise junction being characterized by a stern curvature across said stern, an adjunctive device including a leading edge and a trailing edge, said leading edge being characterized by a leading edge curvature which at least substantially conforms with at least a portion of said stern curvature, said trailing edge curvature being characterized by a trailing edge curvature which is parallel to said leading edge curvature, said adjunctive device being adaptable to association with said nautical vehicle so that said leading edge and at least a portion of said crosswise junction are nearly coincident, said trailing edge curvature thereby being approximately parallel to said at least a portion of said stern curvature.

2. The adjunctive device according to claim 1, wherein said adjunctive device includes a lower surface which is oppositely bounded by said leading edge and said trailing edge.

3. The adjunctive device according to claim 2, wherein:

said lower surface is at least substantially planar;

the perpendicular distance generally across said lower surface between said leading edge curvature and said trailing edge curvature is constant; and said adjunctive device is adaptable to association with said nautical vehicle so that the perpendicular distance generally across said lower surface between said trailing edge curvature and said at least a portion of said stern trailing edge curvature is at least substantially constant.

4. The adjunctive device according to claim 2, wherein said adjunctive device is adaptable to association with said nautical vehicle so that said bottom and said lower surface are at least substantially flush.

5. A method of changing the hydrodynamic character of a hullform having a stern surface and a hull-bottom surface conjoinedly defining a curvilinear transverse stern edge, said method comprising:

providing a flap having a curvilinear leading flap edge, a curvilinear trailing flap edge and a flap undersurface delimited by said leading flap edge and said trailing flap edge, wherein the curvilinearity of said leading flap edge is at least substantially equivalent to the curvilinearity of at least a portion of said transverse stern edge, and wherein the curvilinearity of said trailing flap edge is parallel to the curvilinearity of said leading flap edge; and coupling said flap with said hullform so that said leading flap edge and said at least a portion of said transverse stern edge are at least substantially adjacent, thereby generally establishing a continuity between said hull-bottom surface and said flap undersurface wherein the curvilinearity of said trailing flap edge is at least substantially parallel to the curvilinearity of said at least a portion of said transverse stern edge.

6. The method of changing the hydrodynamic character as recited in claim 5, wherein said coupling said flap results in effectively changing the hydrodynamic shape of said hullform.

7. The method of changing the hydrodynamic character as recited in claim 5, wherein:

said providing said flap includes making said flap; and said coupling said flap results in effectively changing the hydrodynamic shape of said hullform.

8. The method of changing the hydrodynamic character as recited in claim 5, wherein:

the curvilinearity of said trailing flap edge is parallel to the curvilinearity of said leading flap edge in that a one-to-one correspondence exists between the points on said trailing flap edge and the points on said leading flap edge, each pair of corresponding said points describing the same perpendicular first distance therebetween;

the curvilinearity of said trailing flap edge is at least substantially parallel to the curvilinearity of said at least a portion of said transverse stern edge in that a one-to-one correspondence exists between the points on said trailing flap edge and the points on said at least a portion of said transverse stern edge, each pair of corresponding said points describing approximately the same perpendicular second distance therebetween; and said first distance and said second distance are approximately equal.

9. The combination comprising a marine hull and a stern flap, wherein:

said hull includes an underside, a transom and a knuckle edge;

said underside and said transom meet at said knuckle edge;

said knuckle edge is arcuate athwart said hull;

said stern flap includes a lower surface, a port tip, a starboard tip, a leading edge and a trailing edge;

said lower surface is characterized by a span length;

said lower surface includes a port surface section, a starboard surface section and a chord surface section;

said chord surface section is intermediate said port surface section and said starboard surface section;

said chord surface section is characterized by a chord length;

said chord surface section is bounded by said leading edge and said trailing edge;

said leading edge and said trailing edge are each arcuate along said span length;

said chord length is the perpendicular distance measured between said leading edge and said trailing edge and along said chord surface section;

said span length is the distance measured between said port tip and said starboard tip and along said lower surface;

said leading edge fits said knuckle edge so that said leading edge at least substantially abuts said knuckle edge; and said trailing edge and said leading edge are parallel with respect to each other so that throughout said chord surface section said chord length is constant.

10. The combination as defined in claim 9, wherein:

said chord length is an actual chord length;

said combination is characterized by an effective chord length;

said effective chord length is the perpendicular distance measured between said knuckle edge and said trailing edge and along said chord surface section; and said trailing edge and said knuckle edge are characterized by parallelism with respect to each other so that throughout said chord surface section said effective chord length is at least approximately constant.

11. The combination as defined in claim 10, wherein throughout said chord surface section said actual chord length and said effective chord length are at least approximately equal.

12. The combination as defined in claim 11, wherein:

said hull includes a port side, a starboard side, a port transom edge and a starboard transom edge;

said port side and said transom meet at said port transom edge; and said starboard side and said transom meet at said starboard transom edge.

13. The combination as defined in claim 12, wherein:

an imaginary vertical geometric plane can be conceived to longitudinally at least approximately bisect said hull; and said hull, said knuckle, said leading edge and said trailing edge are each at least approximately symmetrical with respect to said geometric plane.

14. The combination as defined in claim 13, wherein:

said geometric plane is at least approximately equidistant between said port transom edge and said starboard transom edge; and said geometric plane is at least approximately equidistant between said port tip and said starboard tip.

15. The combination as defined in claim 9, wherein:

said hull includes a port side, a starboard side, a port transom edge and a starboard transom edge;

said port side and said transom meet at said port transom edge; and said starboard side and side transom meet at said starboard transom edge.

16. The combination as defined in claim 15, wherein:

an imaginary vertical geometric plane can be conceived to longitudinally at least approximately bisect said hull;

said hull, said knuckle, said leading edge and said trailing edge are each at least approximately symmetrical with respect to said geometric plane;

said geometric plane is at least approximately equidistant between said port transom edge and said starboard edge; and said geometric plane is at least approximately equidistant between said port tip and said starboard tip.

* * * * *